US007069656B2

(12) United States Patent
Shin et al.

(10) Patent No.: US 7,069,656 B2
(45) Date of Patent: Jul. 4, 2006

(54) METHODS FOR MANUFACTURING MONOLITHIC INK-JET PRINTHEADS

(75) Inventors: Su-ho Shin, Suwon (KR); Seog-soon Baek, Suwon (KR); Yong-soo Oh, Seongnam (KR); Seung-ju Shin, Seongnam (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/102,735

(22) Filed: Apr. 11, 2005

(65) Prior Publication Data

US 2005/0174391 A1 Aug. 11, 2005

Related U.S. Application Data

(62) Division of application No. 10/682,986, filed on Oct. 14, 2003, now Pat. No. 6,984,024.

(30) Foreign Application Priority Data

Oct. 12, 2002 (KR) ..... 2002-62258

(51) Int. Cl.
*B21D 53/00* (2006.01)
*B41J 2/05* (2006.01)

(52) U.S. Cl. ..... 29/890.1; 29/611; 29/830; 29/831; 29/832; 347/65

(58) Field of Classification Search ..... 29/890.1, 29/611, 830, 831, 832; 216/27, 67, 49, 57; 347/65, 55, 56, 57; 430/320
See application file for complete search history.

(56) References Cited

U.S. PATENT DOCUMENTS

| | | | | |
|---|---|---|---|---|
| 4,438,191 | A | 3/1984 | Cloutier et al. | |
| 4,882,595 | A | 11/1989 | Trueba et al. | |
| 5,841,452 | A | 11/1998 | Silverbrook | |
| 5,855,835 | A | 1/1999 | Gordon et al. | |
| 5,859,654 | A | 1/1999 | Radke et al. | |
| 5,940,957 | A * | 8/1999 | Goto et al. | 29/611 |
| 6,019,457 | A | 2/2000 | Silverbrook | |

(Continued)

FOREIGN PATENT DOCUMENTS

| | | |
|---|---|---|
| EP | 1 174 286 | 1/2002 |

(Continued)

*Primary Examiner*—A. Dexter Tugbang
*Assistant Examiner*—Tai Nguyen
(74) *Attorney, Agent, or Firm*—Lee & Morse, P.C.

(57) ABSTRACT

A monolithic ink-jet printhead includes a substrate having an ink chamber to be filled with ink to be ejected on a front surface, a manifold for supplying ink to the ink chamber on a rear surface, and an ink channel communicating between the ink chamber and the manifold, a barrier wall formed on the front surface of the substrate to a predetermined depth and defining at least a portion of the ink chamber in a width-wise direction, a nozzle plate including a plurality of material layers stacked on the substrate and having a nozzle penetrating the nozzle plate, so that ink ejected from the ink chamber is ejected through the nozzle, a heater formed between adjacent material layers and located above the ink chamber for heating ink to be supplied within the ink chamber; and a conductor for providing current across the heater being provided between adjacent material layers.

27 Claims, 16 Drawing Sheets

U.S. PATENT DOCUMENTS

| | | | | |
|---|---|---|---|---|
| 6,093,330 | A | 7/2000 | Chong et al. | |
| 6,238,584 | B1 * | 5/2001 | Hawkins et al. | 216/27 |
| 6,312,615 | B1 | 11/2001 | Silverbrook | |
| 6,412,918 | B1 * | 7/2002 | Chen et al. | 347/56 |
| 2002/0008738 | A1 | 1/2002 | Lee et al. | |
| 2002/0039127 | A1 | 4/2002 | Shin et al. | |

FOREIGN PATENT DOCUMENTS

| | | |
|---|---|---|
| KR | 2002-0025588 | 4/2002 |

* cited by examiner

METHODS FOR MANUFACTURING MONOLITHIC INK-JET PRINTHEADS

CROSS REFERENCE TO RELATED APPLICATION

This is a divisional application based on application Ser. No. 10/682,986, filed Oct. 14, 2003 now U.S. Pat No. 6.984,024.

BACKGROUND OF THE INVENTION

1. Field of the Invention

The present invention relates to an ink-jet printhead. More particularly, the present invention relates to a thermally driven monolithic ink-jet printhead in which a nozzle plate is formed integrally with a substrate and a manufacturing method thereof.

2. Description of the Related Art

In general, ink-jet printheads print a predetermined color image by repeatedly ejecting a small droplet of a printing ink at a desired position on a recording sheet. Ink-jet printheads are largely categorized into two types depending on the ink droplet ejection mechanisms: a thermally driven ink-jet printhead, in which a heat source is employed to form and expand bubbles in ink causing an ink droplet to be ejected, and a piezoelectrically driven ink-jet printhead in which a piezoelectric crystal bends to exert pressure on ink causing an ink droplet to be expelled.

An ink ejection mechanism of the thermally driven ink-jet printhead will now be described in detail. When a current pulse is applied to a heater consisting of a resistive heating material, heat is generated by the heater to rapidly heat ink near the heater to approximately 300° C. thereby causing the ink to boil and form bubbles. The formed bubbles expand to exert pressure on ink contained within an ink chamber. This pressure causes a droplet of ink to be ejected through a nozzle from the ink chamber.

A thermally driven ink-jet printhead can be further subdivided into top-shooting, side-shooting, and back-shooting types depending on the direction in which the ink droplet is ejected and the directions in which bubbles expand. While the top-shooting type refers to a mechanism in which an ink droplet is ejected in a direction the same as the direction in which the bubble expands, the back-shooting type is a mechanism in which an ink droplet is ejected in a direction opposite to the direction in which the bubble expands. In the side-shooting type, the direction of ink droplet ejection is perpendicular to the direction of bubble expansion.

Thermally driven ink-jet printheads need to meet the following conditions. First, a simple manufacturing process, low manufacturing cost, and mass production must be provided. Second, to produce high quality color images, a spacing between adjacent nozzles must be as small as possible while still preventing cross-talk between the adjacent nozzles. More specifically, to increase the number of dots per inch (DPI), many nozzles must be arranged within a small area. Third, for high speed printing, a cycle beginning with ink ejection and ending with ink refill must be as short as possible. That is, the heated ink and heater should cool down quickly to increase an operating frequency.

FIG. 1A illustrates a partial cross-sectional perspective view showing a structure of a conventional thermally driven printhead. FIG. 1B illustrates a cross-sectional view of the printhead of FIG. 1A for explaining a process of ejecting an ink droplet.

Referring to FIGS. 1A and 1B, a conventional thermally driven ink-jet printhead includes a substrate 10, a barrier wall 14 disposed on the substrate 10 for defining an ink chamber 26 filled with ink 29, a heater 12 disposed in the ink chamber 26, and a nozzle plate 18 having a nozzle 16 for ejecting an ink droplet 29'. If a current pulse is supplied to the heater 12, the heater 12 generates heat to form a bubble 28 in the ink 29 within the ink chamber 26. The bubble 28 expands to exert pressure on the ink 29 present in the ink chamber 26, which causes an ink droplet 29' to be expelled through the nozzle 16. Then, the ink 29 is introduced from a manifold 22 through an ink feed channel 24 to refill the ink chamber 26.

The process of manufacturing a conventional top-shooting type ink-jet printhead configured as above involves separately manufacturing the nozzle plate 18 equipped with the nozzle 16 and the substrate 10 having the ink chamber 26 and ink feed channel 24 formed thereon and bonding them to each other. These required steps complicate the manufacturing process and may cause a misalignment during the bonding of the nozzle plate 18 with the substrate 10. Furthermore, since the ink chamber 26, the ink channel 24, and the manifold 22 are arranged on the same plane, there is a restriction on increasing the number of nozzles 16 per unit area, i.e., the density of nozzles 16. This restriction makes it difficult to implement a high printing speed, high resolution ink-jet printhead.

Recently, in an effort to overcome the above problems of conventional ink-jet printheads, ink-jet printheads having a variety of structures have been proposed. FIGS. 2A and 2B show an example of another conventional monolithic ink-jet printhead. FIGS. 2A and 2B illustrate a plan view showing an example of a conventional monolithic ink-jet printhead and a vertical cross-sectional view taken along line A–A' of FIG. 2A, respectively.

Referring to FIGS. 2A and 2B, a hemispherical ink chamber 32 and a manifold 36 are formed on a front surface, i.e., an upper surface, and a rear surface, i.e., a lower surface, of a silicon substrate 30, respectively, and an ink channel 34 connects the ink chamber 32 with the manifold 36 at a bottom of the ink chamber 32. A nozzle plate 40 comprised of a plurality of stacked material layers 41, 42, and 43 is formed integrally with the substrate 30. The nozzle plate 40 has a nozzle 47 at a location corresponding to a central portion of the ink chamber 32. A heater 45 connected to a conductor 46 is disposed around the nozzle 47. A nozzle guide 44 extends along the edge of the nozzle 47 toward the ink chamber 32. Heat generated by the heater 45 is transferred through an insulating layer 41 to ink 48 within the ink chamber 32. The ink 48 then boils to form bubbles 49. The created bubbles 49 expand to exert pressure on the ink 48 contained within the ink chamber 32, which causes an ink droplet 48' to be expelled through the nozzle 47. Then, the ink 48 flows through the ink channel 34 from the manifold 36 due to surface tension of the ink 48 contacting the air to refill the ink chamber 32.

A conventional monolithic ink-jet printhead configured as above has an advantage in that the silicon substrate 30 is formed integrally with the nozzle plate 40 thereby simplifying the manufacturing process and eliminating the chance of a misalignment problem. Another advantage is that the nozzle 47, the ink chamber 32, the ink channel 34, and the manifold 36 are arranged vertically, which allows an increase in the density of nozzles 46 as compared with the ink-jet printhead of FIG. 1A.

In the monolithic ink-jet printhead shown in FIGS. 2A and 2B, in order to form the ink chamber 32, the substrate 30 is isotropically etched through the nozzle 47, so that the ink chamber 32 is formed in a hemispherical shape. In order to form an ink chamber having a predetermined volume, the ink chamber should have a radius of a predetermined size. Thus, there is a restriction in increasing a nozzle density by further reducing a spacing between two adjacent nozzles 47. More specifically, a reduction in the radius of the ink chamber 32 for the purpose of reducing the spacing between two adjacent nozzles 47 may undesirably result in a reduction in the volume of the ink chamber 32.

As described above, the structure of the conventional monolithic ink-jet printhead has a restriction in realizing high-density nozzle arrangement in spite of recent increasing demand for ink-jet printheads capable of printing higher resolution of images with a high level of DPI (dot per inch).

SUMMARY OF THE INVENTION

It is a feature of an embodiment of the present invention to provide a thermally driven monolithic ink-jet printhead capable of printing higher resolution of images by including an ink chamber configured to reduce a spacing between adjacent nozzles.

It is another feature of an embodiment of the present invention to provide a method of manufacturing the monolithic ink-jet printhead.

In accordance with a feature of the present invention, there is provided a monolithic ink-jet printhead including a substrate having an ink chamber to be filled with ink to be ejected on a front surface, a manifold for supplying ink to the ink chamber on a rear surface, and an ink channel in communication with the ink chamber and the manifold, a barrier wall formed on the front surface of the substrate to a predetermined depth and defining at least a portion of the ink chamber in a width-wise direction, a nozzle plate including a plurality of material layers stacked on the substrate and having a nozzle penetrating the nozzle plate, so that ink ejected from the ink chamber is ejected through the nozzle, a heater formed between adjacent material layers of the plurality of material layers of the nozzle plate and located above the ink chamber for heating ink to be supplied within the ink chamber, and a conductor provided between adjacent material layers of the plurality of material layers of the nozzle plate, the conductor being electrically connected to the heater for applying current across the heater.

The barrier wall preferably surrounds at least a portion of the ink chamber so that the ink chamber is formed in a long, narrow shape. In addition, the barrier wall may surround the ink chamber in a rectangular shape or configuration. One side surface of the barrier wall may be preferably rounded.

The barrier wall is preferably formed of a metal, or an insulating material, such as silicon oxide or silicon nitride.

The nozzle is preferably provided at a width-wise center of the ink chamber. Preferably, the heater is located at a position of the nozzle plate above the ink chamber so as to avoid overlying the nozzle.

The ink channel may be provided at a location suitable to provide flow communication between the ink chamber and the manifold by perpendicularly penetrating the substrate. A cross-sectional shape of the ink channel is preferably circular, oval, or polygonal.

The nozzle plate may include a plurality of passivation layers sequentially stacked on the substrate and a heat dissipating layer made of a heat conductive metal for dissipating heat from the heater to the exterior of the ink-jet printhead. Preferably, the plurality of passivation layers include first through third passivation layers sequentially stacked on the substrate, the heater is formed between the first and second passivation layers, and the conductor is located between the second and third passivation layers.

The heat dissipating layer is preferably made of nickel, copper, or gold, and may be formed by electroplating to a thickness of 10–100 μm.

The nozzle plate may have a heat conductive layer located above the ink chamber, the heat conductive layer being insulated from the heater and conductor and contacting the substrate and heat dissipating layer.

The heat conductive layer is preferably made of a metal and may be made of the same metal and located on the same passivation layer as the conductor.

In addition to the above configuration, an insulating layer may be interposed between the conductor and the heat conductive layer.

Preferably, an upper part of the nozzle formed in the heat dissipating layer is tapered so that a cross-sectional area thereof decreases towards an upper end portion thereof.

In accordance with another feature of the present invention, there is provided a method of manufacturing a monolithic ink-jet printhead including (a) preparing a substrate, (b) forming a barrier wall made of a predetermined material different from a material of the substrate, (c) integrally forming a nozzle plate including a plurality of material layers and having a nozzle penetrating the plurality of material layers, and forming a heater and a conductor connected to the heater between the material layers, (d) forming an ink chamber defined by the barrier wall by isotropically etching the substrate exposed through the nozzle using the barrier wall as an etch stop, (e) forming a manifold for supplying ink by etching a rear surface of the substrate, and (f) forming an ink channel by etching the substrate so that it penetrates the substrate between the manifold and the ink chamber.

In (a), the substrate is preferably made of a silicon wafer.

In (b), the barrier wall may surround at least a portion of the ink chamber so that the ink chamber is formed in a long, narrow shape. Preferably, one side surface of the barrier wall is rounded. In addition, in (b), the barrier wall is preferably formed of a metal. In this case, the (b) may include forming an etch mask defining a portion to be etched on the front surface of the substrate, forming a trench by etching the substrate exposed through the etch mask to a predetermined depth, removing the etch mask, depositing a metal on the front surface of the substrate to fill the trench for forming the barrier wall, and forming a metal material layer made of the metal on the substrate, and removing the metal material layer formed on the substrate.

In (b), the barrier wall may be formed of an insulating material, such as silicon oxide or silicon nitride. In this case, (b) may include forming an etch mask defining a portion to be etched on the front surface of the substrate, forming a trench by etching the substrate exposed through the etch mask to a predetermined depth, removing the etch mask, and depositing the insulating material on the front surface of the substrate to fill the trench for forming the barrier wall, and forming an insulating material layer made of the insulating material on the substrate.

Further, (c) may include (c1) sequentially stacking a plurality of passivation layers on the substrate and forming the heater and the conductor between the passivation layers, and (c2) forming a heat dissipating layer made of a metal on the substrate and forming the nozzle so as to penetrate the passivation layers and the heat dissipating layer.

In this case, (c1) may include forming a first passivation layer on the substrate, forming the heater on the first passivation layer, forming a second passivation layer on the first passivation layer and the heater, forming the conductor on the second passivation layer, and forming a third passivation layer on the second passivation layer and the conductor. Preferably, the heater is formed in a rectangular shape.

In addition, in (c1), a heat conductive layer located above the ink chamber is preferably formed between the passivation layers, such that the heat conductive layer is insulated from the heater and conductor and contacts the substrate and heat dissipating layer. Preferably, the heat conductive layer is formed by depositing a metal to a predetermined thickness. The heat conductive layer may be formed of the same material with the conductor at the same time.

An insulating layer may be formed on the conductor, and the heat conductive layer may then be formed on the insulating layer.

The heat dissipating layer may be formed of nickel, copper, or gold, and is preferably formed by electroplating to a thickness of 10–100 μm.

Further, (c2) may include etching the passivation layers to form a lower nozzle with a predetermined diameter on a portion where the ink chamber is formed, forming a first sacrificial layer within the lower nozzle, forming a second sacrificial layer for forming an upper nozzle on the first sacrificial layer, forming the heat dissipating layer on the passivation layers by electroplating, and removing the second sacrificial layer and the first sacrificial layer, and forming a complete nozzle consisting of the lower and upper nozzles.

The lower nozzle is preferably formed by dry etching the passivation layers using reactive ion etching (RIE).

In addition, after a seed layer for electroplating the heat dissipating layer is formed on the first sacrificial layer and passivation layers, the second sacrificial layer may be formed.

After the lower nozzle is formed and a seed layer for electroplating the heat dissipating layer is formed on the substrate exposed by the passivation layers and lower nozzle, the first sacrificial layer and the second sacrificial layer may be formed sequentially or integrally with each other.

The method may further comprise planarizing the top surface of the heat dissipating layer by chemical mechanical polishing (CMP) after forming the heat dissipating layer.

In (d), horizontal etching may be stopped and only vertical etching may be performed around the barrier wall due to the presence of the barrier wall serving as an etch stop.

In (f), the substrate may be dry etched by reactive ion etching (RIE) from the rear surface of the substrate on which the manifold has been formed to form the ink channel.

In the present invention, since a narrow, long, deep ink chamber is formed using a barrier wall serving as an etch stop, a spacing between adjacent nozzles can be reduced, thereby realizing an ink-jet printhead capable of printing higher resolution of images with a high level of DPI. In addition, since a nozzle plate having a nozzle is formed integrally with a substrate having an ink chamber and an ink channel formed thereon, the ink-jet printhead can be realized on a single wafer in a single process.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
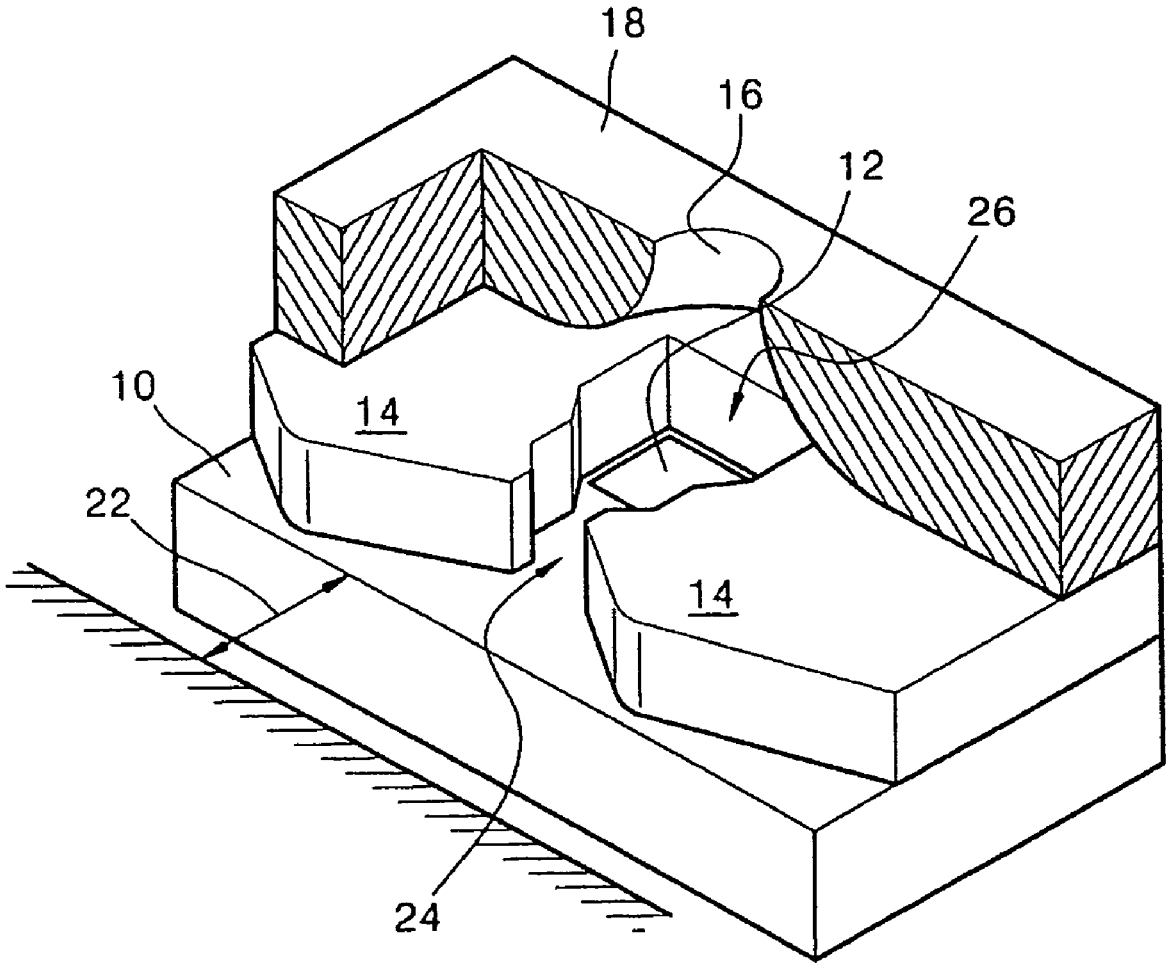
FIG. 1A (PRIOR ART)
FIGS. 1A and 1B illustrate a partial cross-sectional perspective view of a conventional thermally driven ink-jet printhead and a cross-sectional view for explaining a process of ejecting an ink droplet, respectively.
Figure 1B:
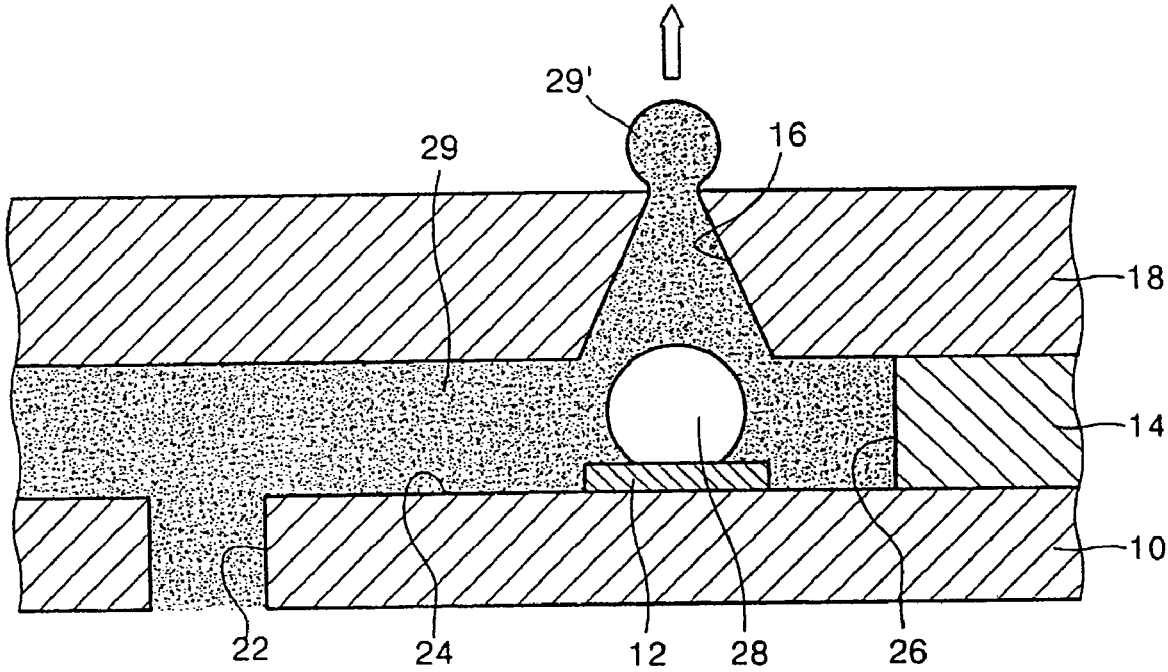
FIG. 1B (PRIOR ART)
Figure 2A:
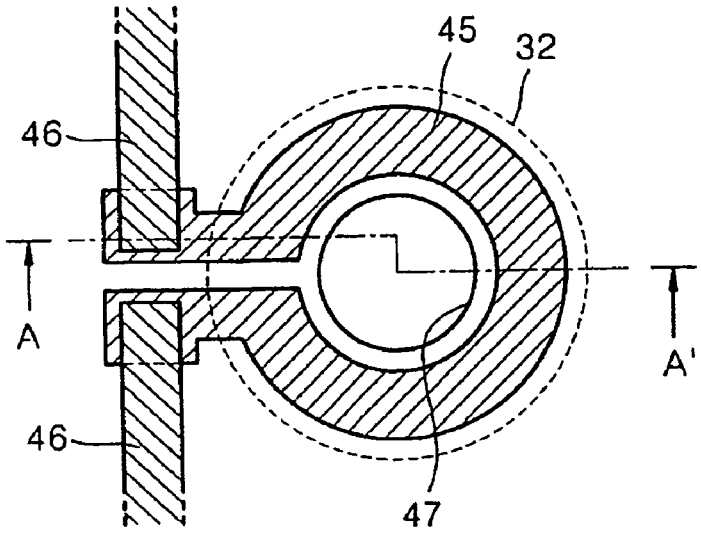
FIG. 2A (PRIOR ART)
FIGS. 2A and 2B illustrate a plan view showing an example of a conventional monolithic ink-jet printhead and a vertical cross-sectional view taken along line A–A' of FIG. 2A, respectively.
Figure 2B:
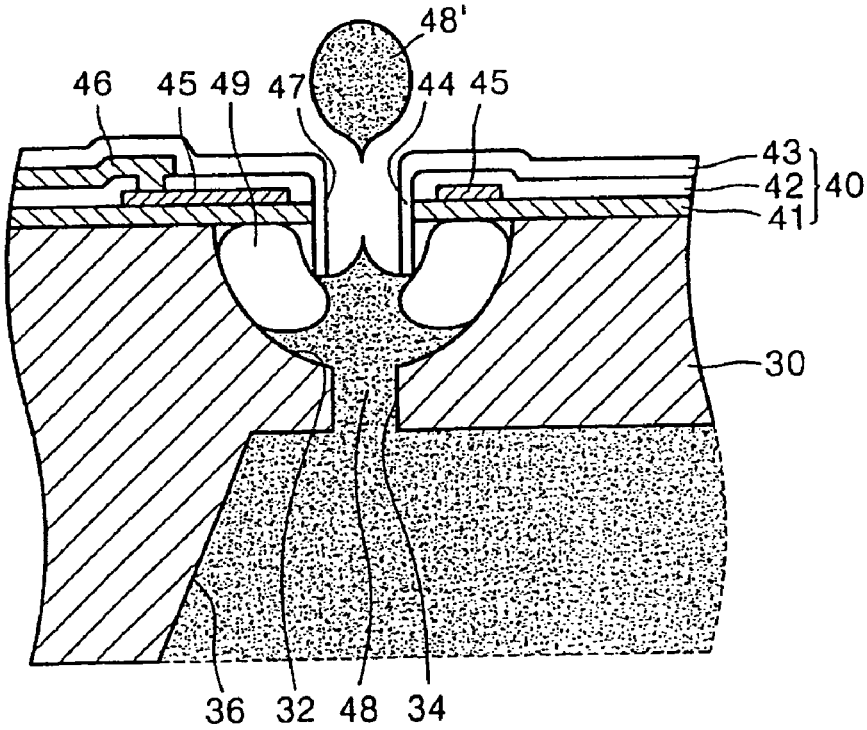
FIG. 2B (PRIOR ART)

Korean Patent Application No. 2002-62258, filed on Oct. 12, 2002, and entitled: "Monolithic Ink-Jet Printhead Having an Ink Chamber Defined by a Barrier Wall and Manufacturing Method Thereof," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions and the sizes of components may be exaggerated for clarity. It will also be understood that when a layer is referred to as being "on" another layer or substrate, it can be directly on the other layer or substrate, or intervening layers may also be present. Like reference numerals refer to like elements throughout.

Figure 3:
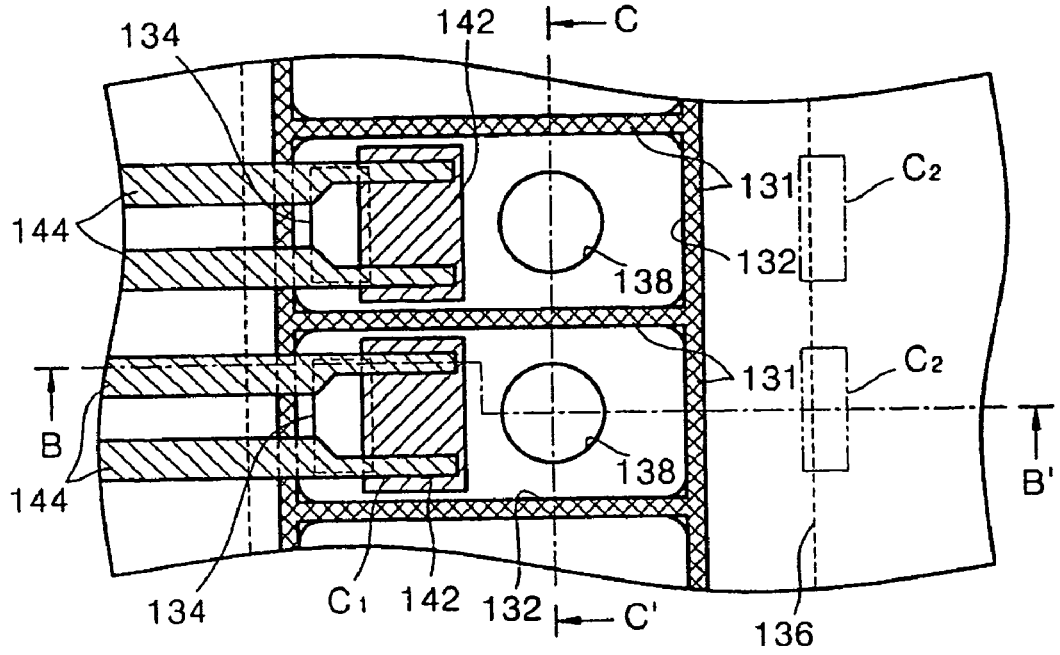
FIG. 3 partially illustrates a planar structure of a monolithic ink-jet printhead according to a preferred first embodiment of the present invention, specifically illustrating a shape and arrangement of an ink passageway and a heater.
Figure 4A:
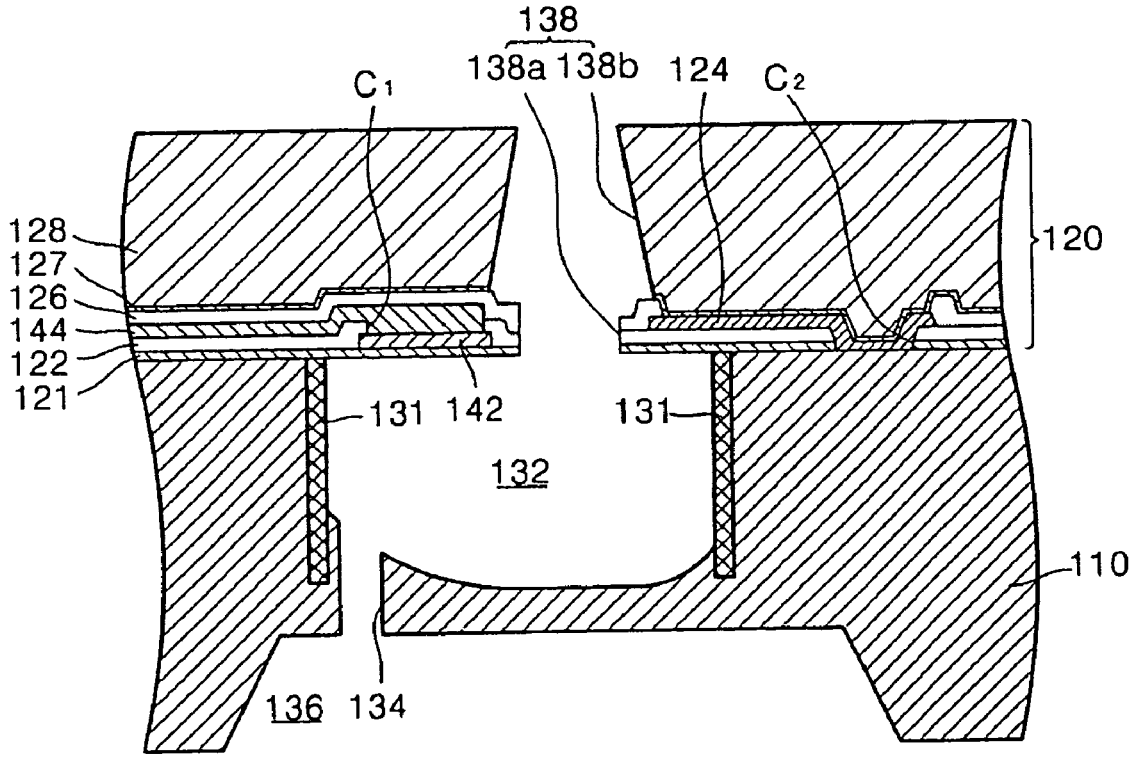
FIGS. 4A and 4B illustrate vertical cross-sectional views of an ink-jet printhead according to the preferred first embodiment of the present invention taken along lines B–B' and C–C' of FIG. 3.
Figure 4B:
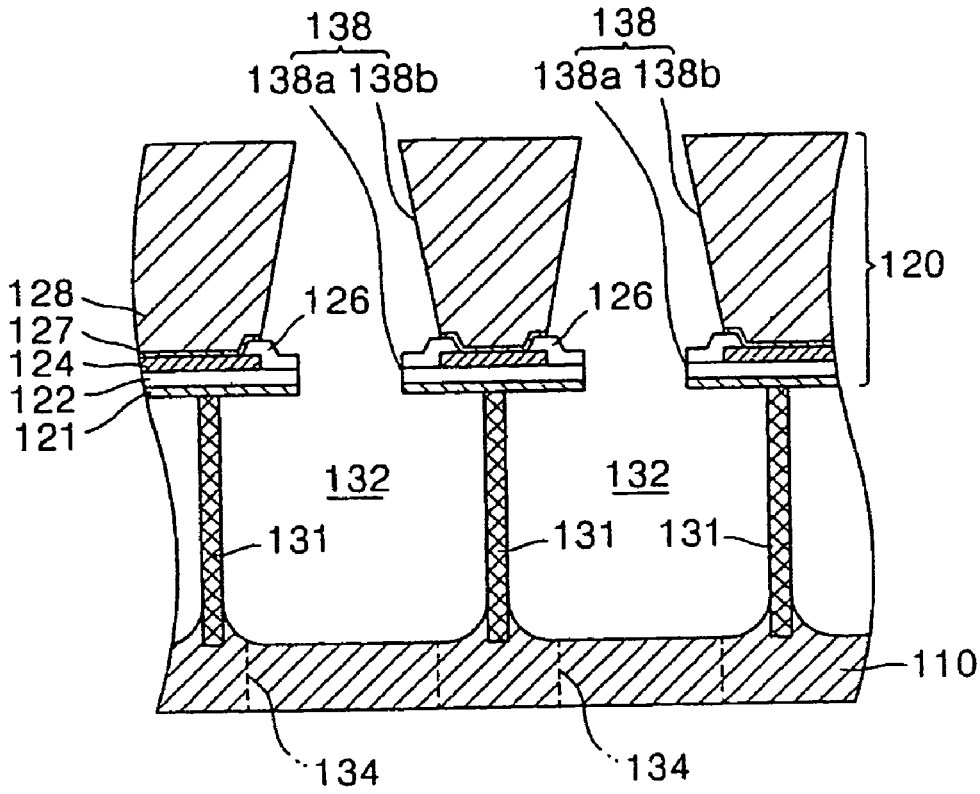
Figure 5:
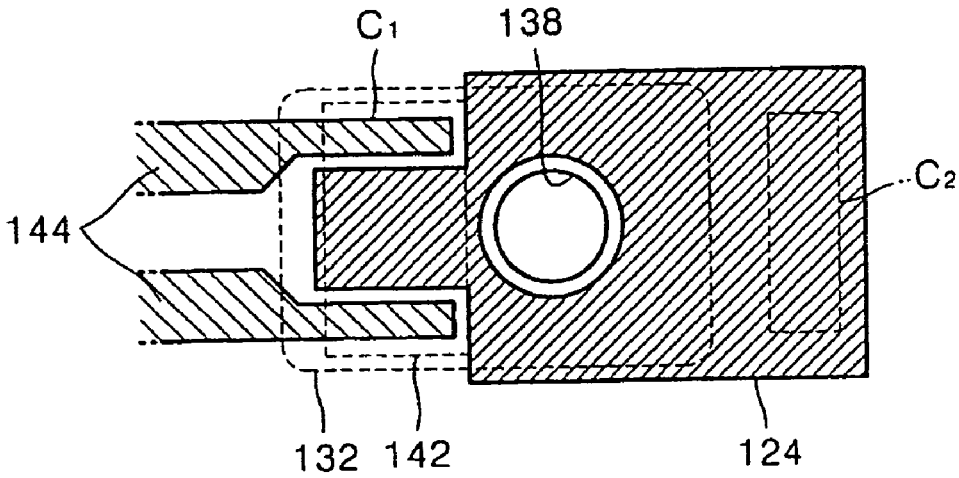
FIG. 5 illustrates a plan view of the planar structure of a heat conductive layer shown in FIG. 4A.

FIG. 3 partially illustrates the planar structure of a monolithic ink-jet printhead according to a preferred first embodiment of the present invention, illustrating the shape and arrangement of an ink passageway and a heater. FIGS. 4A and 4B illustrate vertical cross-sectional views of the ink-jet printhead of the present invention taken along lines B–B' and C–C' of FIG. 3, respectively. FIG. 5 illustrates a plan view showing the planar structure of a heat conductive layer shown in FIG. 4A.

Referring to FIGS. 3, 4A and 4B, the ink-jet printhead according to a preferred first embodiment of the present invention includes an ink passageway connected from an ink reservoir (not shown) to a manifold 136, an ink channel 134, an ink chamber 132 and to a nozzle 138. The manifold 136 is formed at a rear surface, i.e., a lower surface, of a substrate 110 of the printhead and supplies ink from the ink reservoir to the ink chamber 132. The ink chamber 132 is formed on a front surface, i.e., an upper surface, of the substrate 110, and ink to be ejected is supplied therein. The ink channel 134 is formed to perpendicularly penetrate the substrate 110 between the ink chamber 132 and the manifold 136.

In the ink-jet printhead fabricated in a chip state, as shown in FIG. 3, a plurality of ink chambers 132 are arranged on the manifold 136 connected to the ink reservoir in one or two rows, or in three or more rows to achieve higher resolution. Thus, a plurality of ink channels 134, nozzles 138 and heaters 142, each provided for one ink chamber 132, are also arranged on the manifold 136 in one or more rows.

Here, a silicon wafer widely used to manufacture integrated circuits (ICs) may be used as the substrate 110.

In the present invention, the ink chamber 132 is defined by a barrier wall 131. The barrier wall 131 is formed on the front surface of the substrate 110 to a predetermined depth in consideration of the depth of the ink chamber 132, for example, between about several micrometers to several tens micrometers.

Since the shape of a plane surrounded by the barrier wall 131 may be rectangular, the ink chamber 132 is narrow, long and deep. Thus, the ink chamber 132 is capable of accommodating ink enough to eject ink droplets even if it is narrow in a direction in which nozzles are arranged. If the width of the ink chamber 132 is small, a spacing between adjacent nozzles 138 is reduced, so that a high-density arrangement of the nozzles 138 may be provided, thereby achieving an ink-jet printhead with print resolution of a high level of DPI.

The rectangular barrier wall 131 surrounding the ink chamber 132 may be separately provided at each of the plurality of the ink chambers 132, and a part of the barrier wall 131 positioned between adjacent ink chambers 132 can be shared by the adjacent ink chambers 132. In this case, the part of the barrier wall 131 positioned between adjacent ink chambers 132 is thick in order to withstand pressure changes in the ink chamber 132, for example, a thickness of the barrier wall 131 may be about several micrometers.

As described above, within the range in which the width of the ink chamber 132 is defined, the plane surrounded by the barrier wall 131 may take various shapes other than a rectangle, which will later be described.

The barrier wall 131 is formed of a different material from the substrate 110, which allows the barrier wall 131 to serve as an etch stop in the process of forming the ink chamber 132, which will be described below. Thus, if the substrate 110 is a silicon wafer, the barrier wall 131 may be formed of an insulating material such as silicon oxide or silicon nitride, which is advantageous in that the same material can be used for both the barrier wall 131 and a first passivation layer 121. The barrier wall 131 may alternately be formed of a metal material, which is advantageous in that heat inside the ink chamber 132 can be dissipated through the barrier wall 131 relatively rapidly.

The ink channel 134 can be formed perpendicularly at a position deviating from the center of the ink chamber 132, that is, at a peripheral portion of the ink chamber 132. Thus, the ink channel 134 is positioned under the heater 142, rather than under the nozzle 138.

The cross-section of the ink channel 134 is preferably shaped of a rectangle elongated in a width direction of the ink chamber 132. In addition, the ink channel 134 may have various cross-sectional shapes such as circular, oval or polygonal.

In addition, the ink channel 134 may be formed at any location other than under the heater 142 that can connect the ink chamber 132 with the manifold 136 by perpendicularly penetrating the substrate 110.

A nozzle plate 120 is formed on the substrate 110 having the ink chamber 132, the ink channel 134, and the manifold 136 formed thereon. The nozzle plate 120, which forms an upper wall of the ink chamber 132, includes the nozzle 138, through which ink is ejected. The nozzle 138 is formed in the width-wise center of the ink chamber 132 by perpendicularly penetrating the nozzle plate 120.

The nozzle plate 120 is comprised of a plurality of material layers stacked on the substrate 110. The plurality of material layers may consist of first, second and third passivation layers 121, 122 and 126. Preferably, the plurality of material layers further includes a heat dissipating layer 128 made of a metal. More preferably, the plurality of material layers further includes a heat conductive layer 124. The heater 142 is provided between the first and second passivation layers 121 and 122, and a conductor 144 is provided between the second and third passivation layers 122 and 126.

The first passivation layer 121, the lowermost layer among the plurality of material layers forming the nozzle plate 120, is formed on the front surface of the substrate 110. The first passivation layer 121 for providing electrical insulation between the overlying heater 142 and underlying substrate 110, as well as for protecting the heater 142, may be made of silicon oxide or silicon nitride. In particular, in the case where the barrier wall 131 is made of an insulating material, the first passivation layer 121 and the barrier wall 131 are preferably formed of the same material.

The heater 142 overlying the ink chamber 132 to heat ink inside the ink chamber 132 is formed on the first passivation layer 121. The heater 142 consists of a resistive heating material, such as polysilicon doped with impurities, tantalum-aluminum alloy, tantalum nitride, titanium nitride, and tungsten silicide. The heater 142 may be rectangular. Further, the heater 142 is located at a position above the ink chamber 132 so as to avoid overlaying the nozzle 138, that is, at a location deviating from the center of the ink chamber 132. More specifically, since the nozzle 138 is formed to one side of the lengthwise center of the ink chamber 132, the heater 142 is disposed to the other side of the lengthwise center of the ink chamber 132.

The second passivation layer 122 is formed on the first passivation layer 121 and the heater 142 for providing insulation between the overlying heat conductive layer 124 and the underlying heater 142, as well as for protecting the heater 142. Similarly to the first passivation layer 121, the second passivation layer 122 may be made of silicon nitride and silicon oxide.

The conductor 144 electrically connected to the heater 142 for applying a current pulse across the heater 142 is placed on the second passivation layer 122. While a first end of the conductor 144 is coupled to the heater 142 through a first contact hole $C_1$ formed in the second passivation layer 122, a second end is electrically connected to a bonding pad (not shown). The conductor 144 may be made of a highly conductive metal such as aluminum, aluminum alloy, gold, or silver.

The heat conductive layer 124 may overlie the second passivation layer 122. The heat conductive layer 124 functions to conduct heat residing in or around the heater 142 to the substrate 110 and the heat dissipating layer 128 which will be described later, and is preferably formed as widely as possible to cover the ink chamber 132 and the heater 142 entirely, as shown in FIG. 5. The heat conductive layer 124 needs to be spaced apart a predetermined distance from the conductor 144 to provide insulation. The insulation between the heat conductive layer 124 and the conductor 144 can be achieved by the second passivation layer 122 interposed therebetween. Furthermore, the heat conductive layer 124 contacts the top surface of the substrate 110 through a second contact hole $C_2$ penetrating the first and second passivation layers 121 and 122.

The heat conductive layer 124 is made of a metal having good conductivity. When both heat conductive layer 124 and the conductor 144 are formed on the second passivation layer 122, the heat conductive layer 124 may be made of the same material as the conductor 144, such as aluminum, aluminum alloy, gold, or silver.

To form the heat conductive layer 124 having a greater thickness than the conductor 144 or to form the heat conductive layer 124 using a different metal material from the conductor 144, an insulating layer (not shown) may be provided between the conductor 144 and the heat conductive layer 124.

The third passivation layer 126 overlying the conductor 144 and the second passivation layer 122 may be made of tetraethylorthosilicate (TEOS) oxide or silicon oxide. It is desirable to avoid forming the third passivation layer 126 over the heat conductive layer 124 to avoid contacting the heat conductive layer 124 and the heat dissipating layer 128.

The heat dissipating layer 128, the uppermost layer from among the plurality of material layers forming the nozzle plate 120, is made of a metal having high thermal conductivity such as nickel, copper, or gold. The heat dissipating layer 128 is formed as thickly as about 10–100 μm by electroplating the metal on the third passivation layer 126 and the heat conductive layer 124. To accomplish this formation, a seed layer 127 for electroplating the metal is disposed on top of the third passivation layer 126 and the heat conductive layer 124. The seed layer 127 may be made of a metal having good electric conductivity such as copper, chrome, titanium, gold or nickel.

Since the heat dissipating layer 128 made of a metal as described above is formed by a electroplating process, it can be formed integrally with other components of the ink-jet printhead and relatively thickly, thus providing effective heat dissipation.

The heat dissipating layer 128 functions to dissipate the heat from the heater 142 or from around the heater 142 to the outside. More specifically, the heat residing in or around the heater 142 after ink ejection is guided to the substrate 110 and the heat dissipating layer 128 via the heat conductive layer 124 and then dissipates to the outside. This allows quick heat dissipation after ink ejection and lowers the temperature near the nozzle 138, thereby providing stable printing at a high operating frequency.

A relatively thick heat dissipating layer 128 as described above makes it possible to sufficiently secure the length of the nozzle 138, which enables stable high speed printing while improving the directionality of an ink droplet being ejected through the nozzle 138. Thus, the ink droplet can be ejected in a direction exactly perpendicular to the substrate 110.

The nozzle 138, consisting of a lower part 138*a* and an upper part 138*b*, is formed in and penetrates the nozzle plate 120. The lower part 138*a* of the nozzle 138 is formed in a pillar shape by penetrating the passivation layers 121, 122, and 126 of the nozzle plate 120. The upper part 138*b* of the nozzle 138 is formed in and penetrates the heat dissipating layer 128. The upper part 138*b* of the nozzle 138 may also be formed in a pillar shape. However, the upper part 138*b* is preferably tapered so that a cross-sectional area decreases toward an upper opening thereof. If the upper part 138*b* has a tapered shape as described above, a meniscus in the ink surface is more quickly stabilized after ink ejection.

Figure 6A:
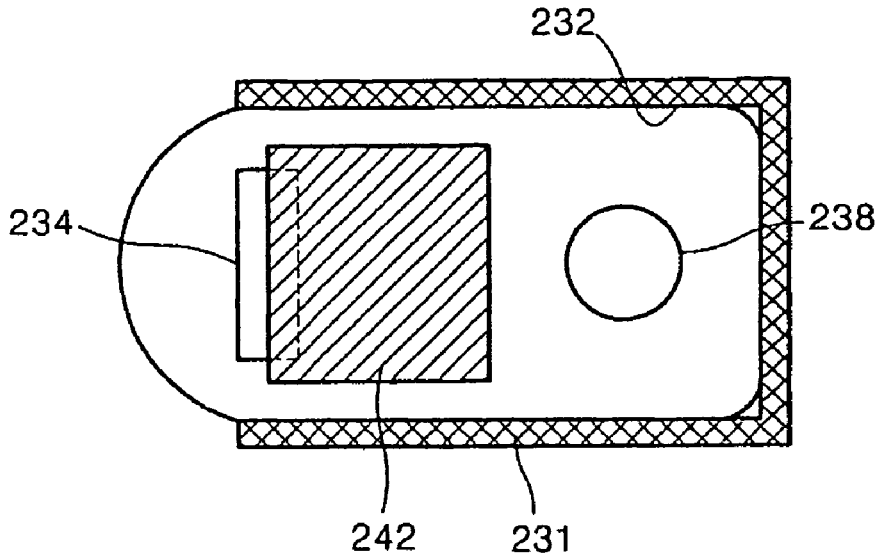
FIGS. 6A and 6B illustrate a plan view and a cross-sectional view, respectively, of a barrier wall and an ink chamber in an ink-jet printhead according to a second embodiment of the present invention.
Figure 6B:
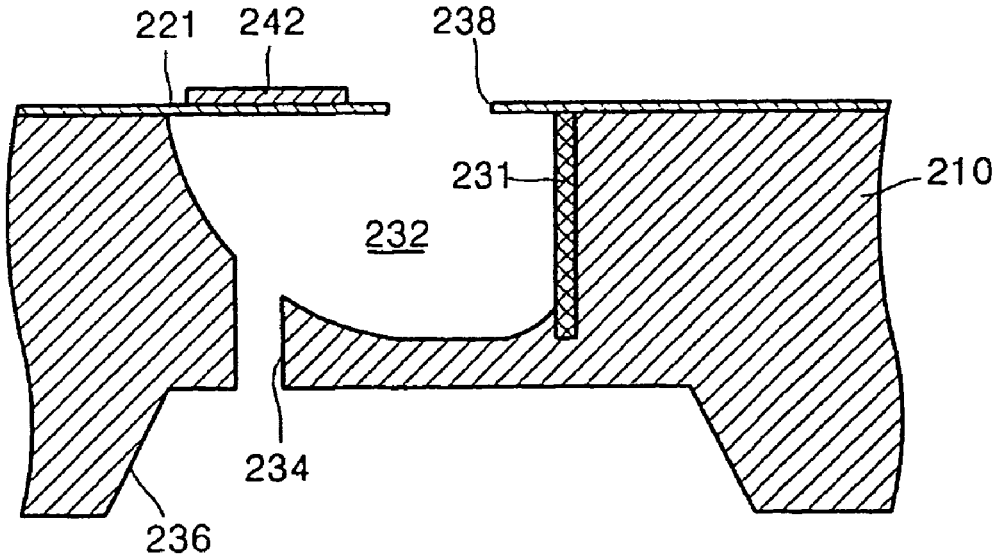

FIGS. 6A and 6B illustrate a plan view and a cross-sectional view, respectively, of a barrier wall and an ink chamber in an ink-jet printhead according to a second embodiment of the present invention.

Referring to FIGS. 6A and 6B, a barrier wall 231 is formed such that it surrounds a portion of an ink chamber 232, for example, three sides of the ink chamber 232, within a substrate 210. Accordingly, the ink chamber 232 defined by the barrier wall 231 is formed in a narrow, long shape. One side of the ink chamber 232 where the barrier wall 231 is not formed, is rounded by isotropically etching the substrate 210. The shapes and arrangement of other components of the ink-jet printhead, that is, a heater 242 formed on a first passivation layer 221, a nozzle 238, an ink channel 234 and a manifold 236, are the same as those in the above-described first embodiment.

Figure 7:
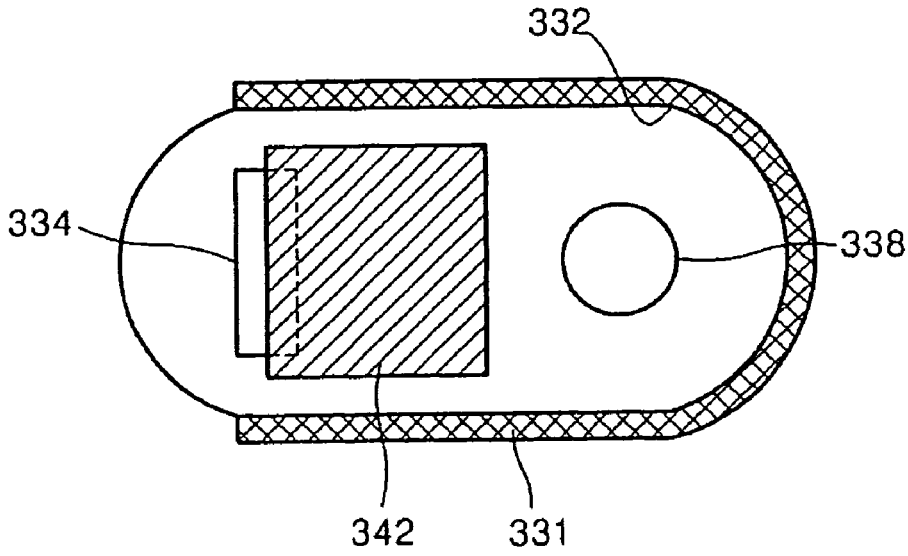
FIG. 7 illustrates a plan view of a barrier wall and an ink chamber in an ink-jet printhead according to a third embodiment of the present invention.

FIG. 7 illustrates a plan view of a barrier wall and an ink chamber in an ink-jet printhead according to a third embodiment of the present invention. The cross-sectional view of the ink-jet printhead shown in FIG. 7 is the same as that shown in FIG. 6B, and accordingly, an explanation thereof will be omitted.

Referring to FIG. 7, as in the above-described second embodiment, a barrier wall 331 is formed such that it surrounds a portion of an ink chamber 332, for example, three sides of the ink chamber 232. In this third embodiment, one side of the barrier wall 331 may be rounded. Accordingly, the ink chamber 332 defined by the barrier wall 331 is formed in a narrow, long shape, as described above. The shapes and arrangement of other components of the ink-jet printhead, that is, a heater 342, a nozzle 338 and an ink channel 334, are the same as those in the above-described second embodiment.

Figure 8A:
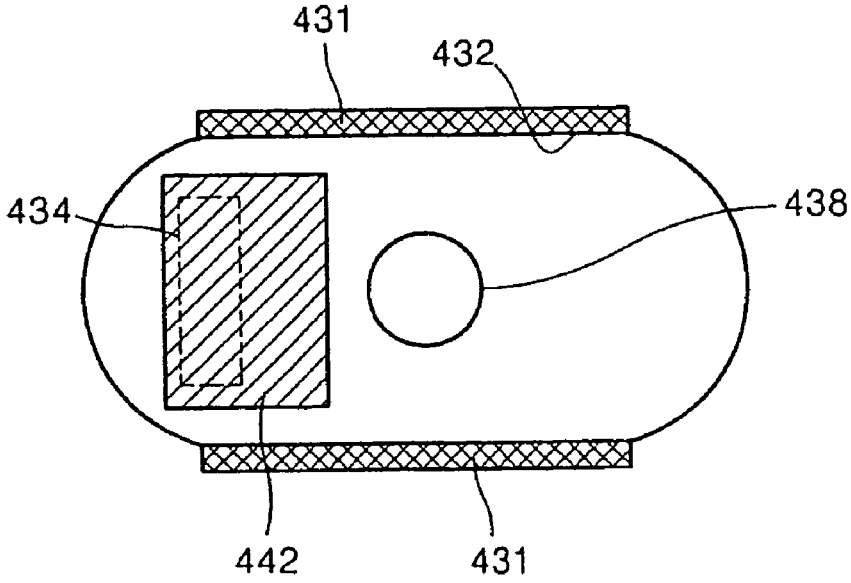
FIGS. 8A and 8B illustrate a plan view and a cross-sectional view, respectively, of a barrier wall and an ink chamber in an ink-jet printhead according to a fourth embodiment of the present invention.
Figure 8B:
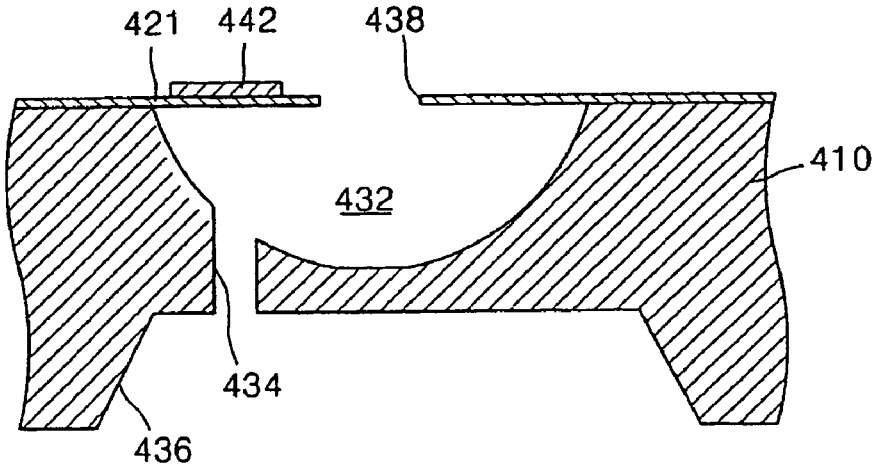

FIGS. 8A and 8B illustrate a plan view and a cross-sectional view, respectively, of a barrier wall and an ink chamber in an ink-jet printhead according to a fourth embodiment of the present invention.

Referring to FIGS. 8A and 8B, a barrier wall 431 is separated into two parts on opposite sides of an ink chamber 432 in the width-wise direction. Thus, the barrier wall 431 defines only the width of the ink chamber 432. Accordingly, the ink chamber 432 defined by the barrier wall 431 may be formed in a narrow, long shape. Both lengthwise sides of the ink chamber 432 where the barrier wall 431 is not formed, are rounded by isotropically etching a substrate 410.

According to this fourth embodiment, a nozzle 438 is provided at the lengthwise center of the ink chamber 432. A heater 442 formed on a first passivation layer 421 may be rectangular. The heater 442 may be located to one side of the nozzle 438. However, the heater 442 may also be located at on opposite sides of the nozzle 438. In addition, the heater 442 may be formed such that it surrounds the nozzle 438.

The shapes and arrangement of other components of the ink-jet printhead, that is, an ink channel 434 and a manifold 436, are the same as those in the above-described third embodiment.

An ink ejection mechanism in the ink-jet printhead shown in FIG. 3 will now be described with reference to FIGS. 9A through 9C.

Figure 9A:
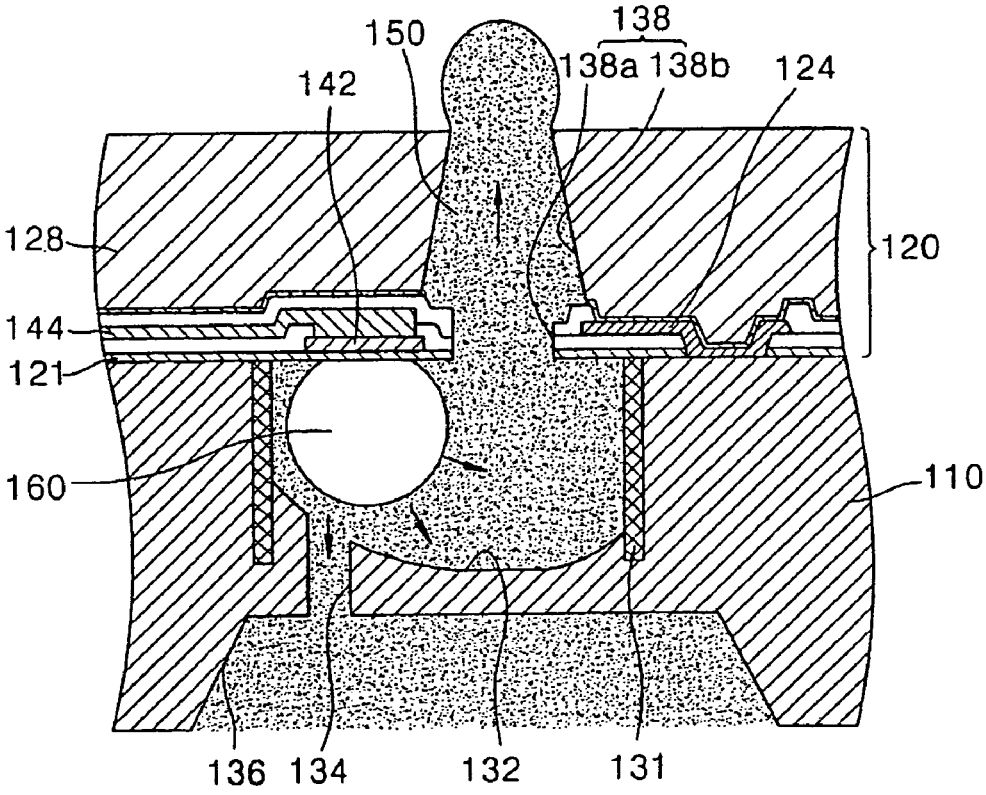
FIGS. 9A through 9C illustrate an ink ejection mechanism in the ink-jet printhead shown in FIG. 3.

First, referring to FIG. 9A, if a current pulse is applied to the heater 142 through the conductor 144 when the ink chamber 132 and the nozzle 138 are filled with ink 150, heat is generated by the heater 142 and transmitted through the first passivation layer 121 underlying the heater 142 to the ink 150 within the ink chamber 132. The ink 150 then boils to form bubbles 160. As the bubbles 160 expand upon a supply of heat, the ink 150 within the nozzle 138 is ejected out of the nozzle 138.

Figure 9B:
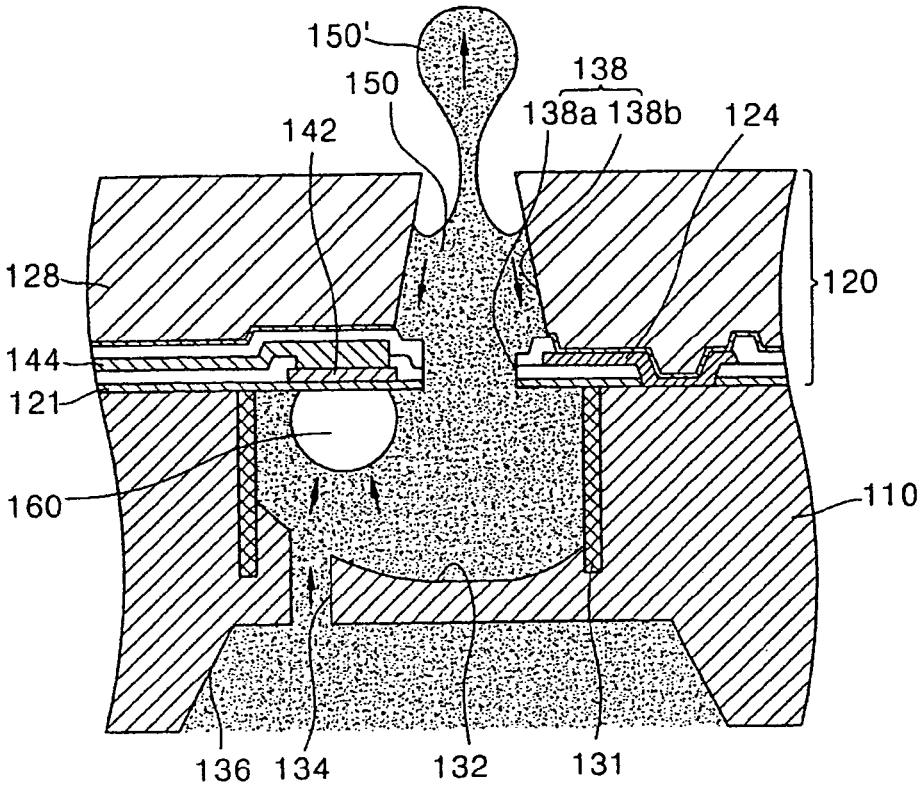

Referring to FIG. 9B, if a current pulse cuts off when the bubble 160 expands to a maximum size thereof, the bubble 160 then shrinks until it collapses completely. At this time, a negative pressure is formed in the ink chamber 132 so that the ink 150 within the nozzle 138 returns to the ink chamber 132. At the same time, a portion of the ink 150 being pushed out of the nozzle 138 is separated from the ink 150 within the nozzle 138 and ejected in the form of an ink droplet 150' due to an inertial force.

A meniscus in the surface of the ink 150 retreats toward the ink chamber 132 after ink droplet 150' separation. In this case, the nozzle 138 is sufficiently long due to the thick nozzle plate 120 so that the meniscus retreats only within the nozzle 138 and not into the ink chamber 132. Thus, this prevents air from flowing into the ink chamber 132 while quickly restoring the meniscus to an original state, thereby stably maintaining high speed ejection of the ink droplet 150'. Furthermore, since heat residing in or around the heater 142 is dissipated into the substrate 110 or to the outside by conduction heat transfer through the heat conductive layer 124 and the heat dissipating layer 128, the temperature in or around the heater 142 and nozzle 138 drops more quickly. Here, if the barrier wall 131 is made of a metal material, heat dissipation is performed even more rapidly.

Figure 9C:
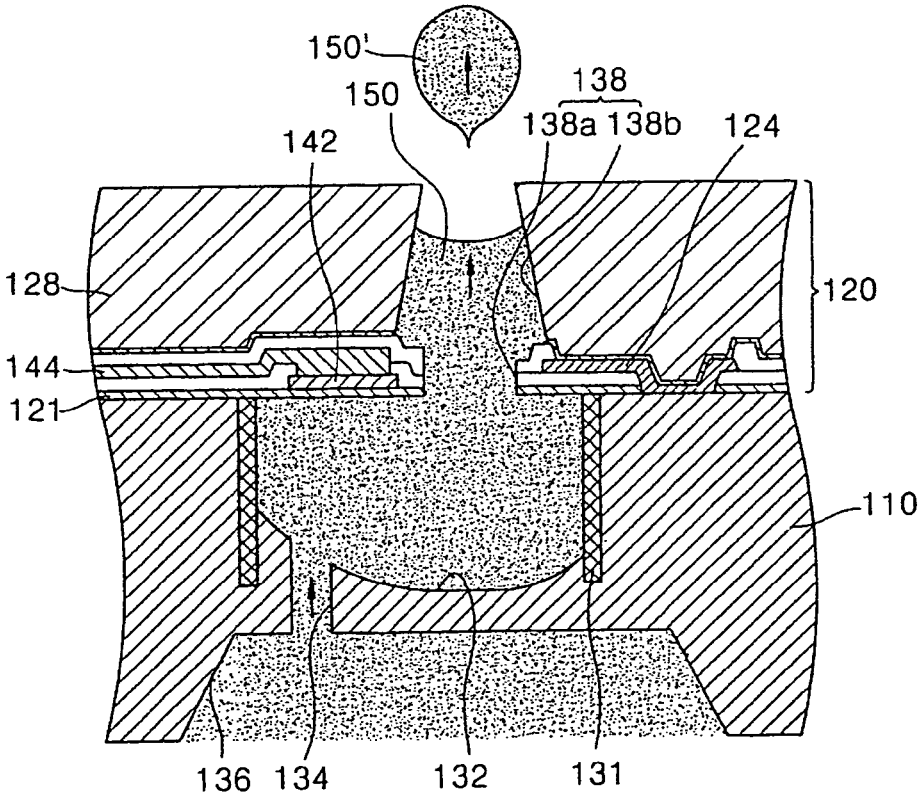

Next, referring to FIG. 9C, as the negative pressure within the ink chamber 132 disappears, the ink 150 flows again toward the exit of the nozzle 138 due to a surface tension force acting at a meniscus formed in the nozzle 138. If the upper part 138*b* of the nozzle 138 is tapered, the speed at which the ink 150 flows upward further increases. The ink 150 is then supplied through the ink channel 134 to refill the ink chamber 132. When ink refill is completed so that the printhead returns to an initial state, the ink ejection mechanism is repeated. During the above process, the printhead can thermally recover the original state thereof more quickly because of heat dissipation through the heat conductive layer 124 and heat dissipating layer 128.

A method of manufacturing a monolithic ink-jet printhead configured above according to a preferred embodiment of this invention will now be described.

FIGS. 10 through 22 illustrate cross-sectional views for explaining stages in a method of manufacturing the ink-jet printhead shown in FIG. 3. FIG. 23 illustrates an alternate method of forming a seed layer and sacrificial layers. Methods of manufacturing the ink-jet printheads having the nozzle plates according to the second through fourth embodiments as shown in FIGS. 6A, 7 and 8A are the same as described below except for the shapes of a barrier wall and an ink chamber.

Figure 10:
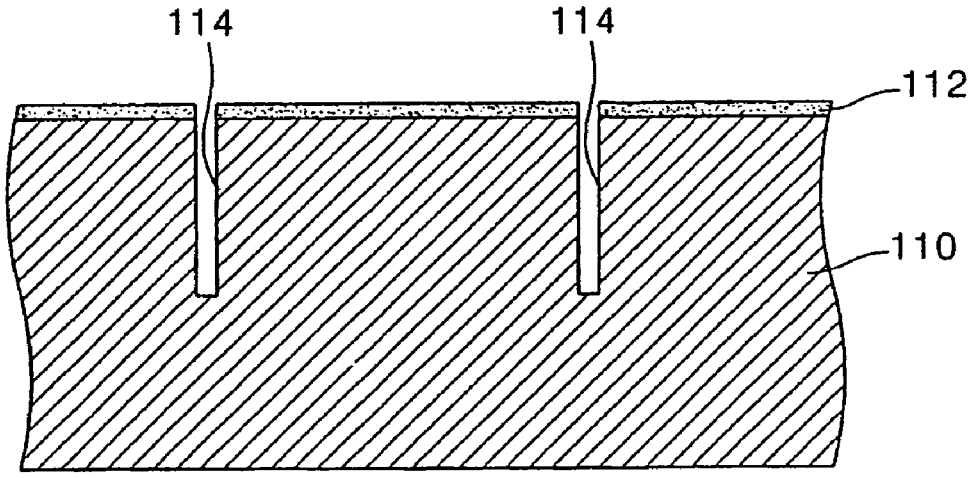
FIGS. 10 through 22 illustrate cross-sectional views for explaining stages in a method of manufacturing the ink-jet printhead shown in FIG. 3.

Referring to FIG. 10, a silicon wafer used for the substrate 110 has been processed to have a thickness of approximately 300–500 μm. The silicon wafer is widely used for manufacturing semiconductor devices and effective for mass production.

While FIG. 10 shows a very small portion of the silicon wafer, the ink-jet printhead according to the present invention may be fabricated in tens to hundreds of chips on a single wafer.

An etch mask 112 that defines a portion to be etched is formed on the surface of the substrate 110. The etch mask 112 can be formed by coating a photoresist on the front surface of the substrate 110 and patterning the same.

The substrate 110 exposed by the etch mask 112 is then etched to form a trench 114 having a predetermined depth. The substrate 110 is dry-etched by reactive ion etching (RIE). The depth of the trench 114 is determined to be in the range of about several micrometers to several tens micrometers in consideration of the depth of the ink chamber (132 of FIG. 21). The width of the trench 114 is in the range of about several micrometers, i.e., wide enough so that a predetermined material may easily be filled therein. The trench 114 surrounds a portion where the ink chamber 132 is to be formed in a rectangular shape. In the ink chamber 232, 332 or 432 shown in FIGS. 6A, 7 or 8A, respectively, the trench 114 may have various shapes adapted to the shape of each ink chamber. More specifically, the trench 114 may surround parts of the ink chamber 232, 332 or 432, and the trench 114 may be rounded partially at an internal surface thereof.

Figure 11:
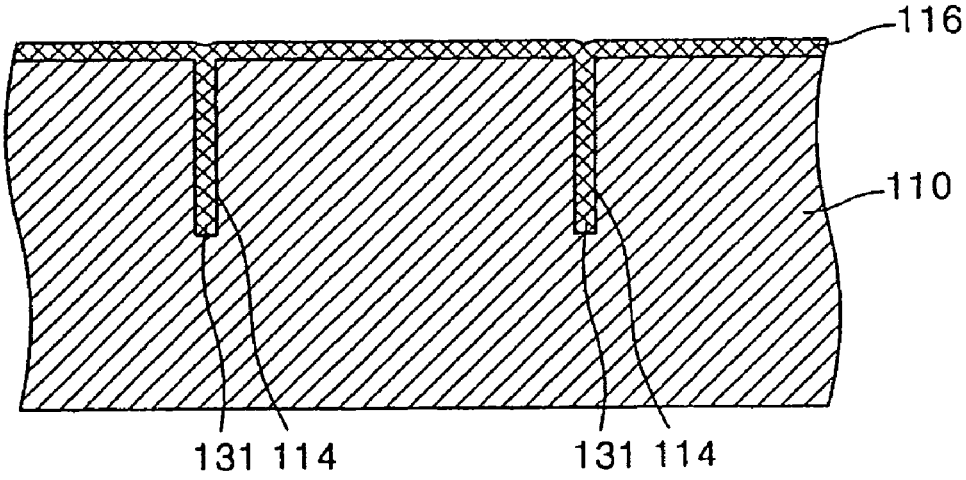
Figure 21:
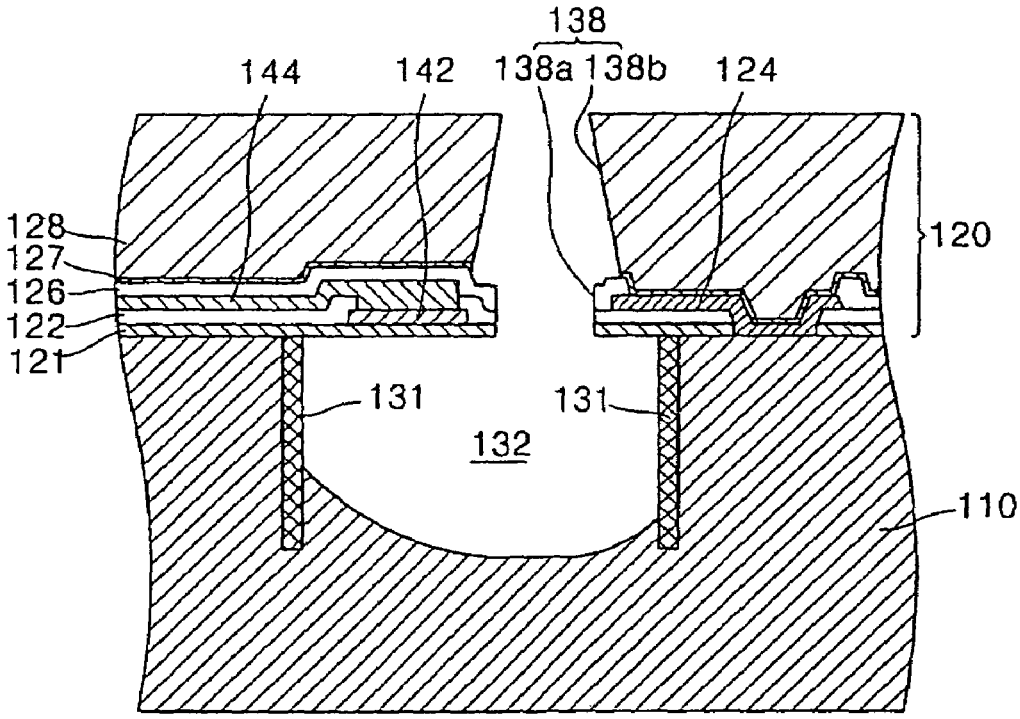

After forming the trench 114, the etch mask 112 on the substrate 110 is removed. As shown in FIG. 11, a predetermined material is deposited on the surface of the substrate 110 having the trench 114. Accordingly, the trench 114 is filled with the predetermined material, thereby forming the barrier wall 131. In addition, a material layer 116 is formed on the substrate 110. The predetermined material is different from a material forming the substrate 110. This difference allows the barrier wall 131 to serve as an etch stop when the ink chamber 132 is formed by etching the substrate 110, as shown in FIG. 21. Thus, if the substrate 110 is made of silicon, an insulating material, such as silicon oxide or silicon nitride, or a metallic material, can be used as the predetermined material.

Figure 12:
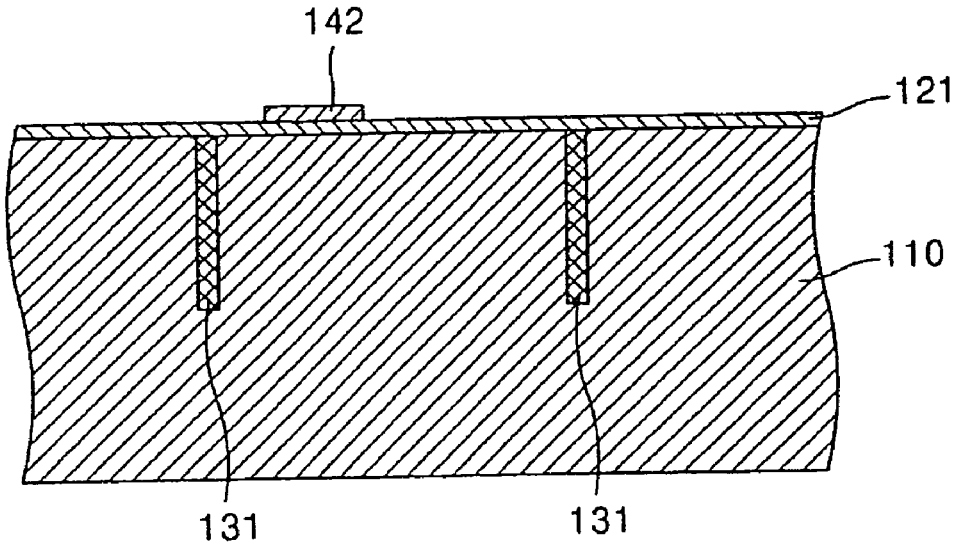

If the barrier wall 131 and the material layer 116 are made of an insulating material like the first passivation layer 121, shown in FIG. 12, the material layer 116 can be used as the first passivation layer 121, making it possible to omit a step of separately forming the first passivation layer 121.

If the barrier wall 131 and the material layer 116 are made of a metallic material, the material layer 116 on the substrate 110 is etched for removal, and then steps shown in FIG. 12 are performed.

As shown in FIG. 12, the first passivation layer 121 is formed over the substrate 110 having the barrier wall 131. The first passivation layer 121 is formed by depositing silicon oxide or silicon nitride on the substrate 110.

The heater 142 is then formed on the first passivation layer 121 overlying the substrate 110. The heater 142 is formed by depositing a resistive heating material, such as polysilicon doped with impurities, tantalum-aluminum alloy, tantalum nitride, titanium nitride, or tungsten silicide, over the entire surface of the first passivation layer 121 to a predetermined thickness and patterning the same in a predetermined shape, e.g., in a rectangular shape. Specifically, while the polysilicon doped with impurities, such as phosphorus (P) contained in a source gas, can be deposited by low pressure chemical vapor deposition (LPCVD) to a thickness of approximately 0.7–1 μm, tantalum-aluminum alloy, tantalum nitride, titanium nitride, or tungsten silicide may be deposited by sputtering or chemical vapor deposition (CVD) to a thickness of about 0.1–0.3 μm. The deposition thickness of the resistive heating material may be determined in a range other than the range given here to have an appropriate resistance considering the width and length of the heater 142. The resistive heating material deposited over the entire surface of the first passivation layer 121 can be patterned by a lithography process using a photomask and a photoresist and an etching process using a photoresist pattern as an etch mask.

Figure 13:
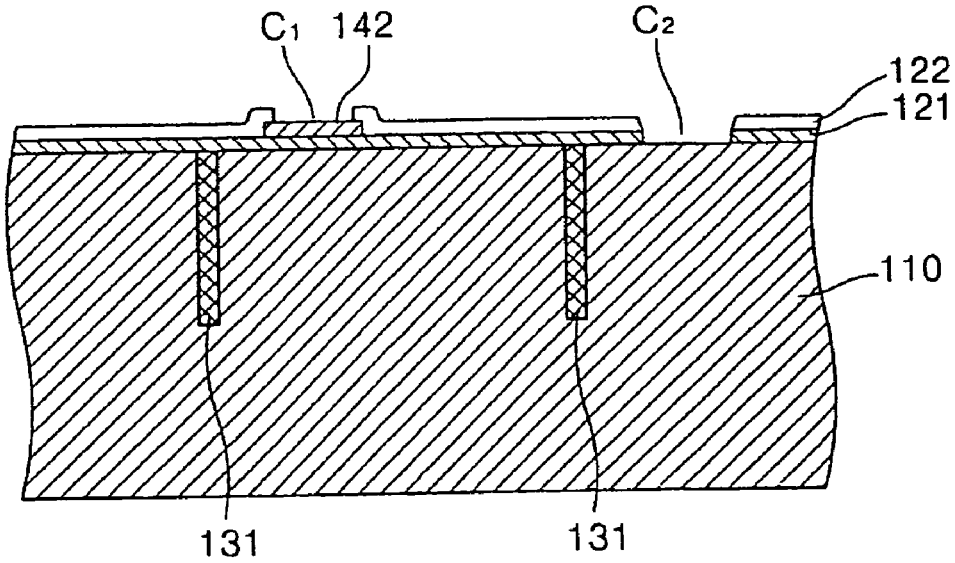

Then, as shown in FIG. 13, the second passivation layer 122 is formed on the first passivation layer 121 and the heater 142. The second passivation layer 122 is formed by depositing silicon oxide or silicon nitride to a thickness of about 0.5 μm. The second passivation layer 122 is then partially etched to form a first contact hole C, exposing a portion of the heater 142 to be coupled with the conductor 144 in a step shown in FIG. 14, and the second and first passivation layers 122 and 121 are sequentially etched to form a second contact hole $C_2$ exposing a portion of the substrate 110 to contact the heat conductive layer 124 in the step shown in FIG. 14. The first and second contact holes $C_1$ and $C_2$ can be formed simultaneously.

Figure 14:
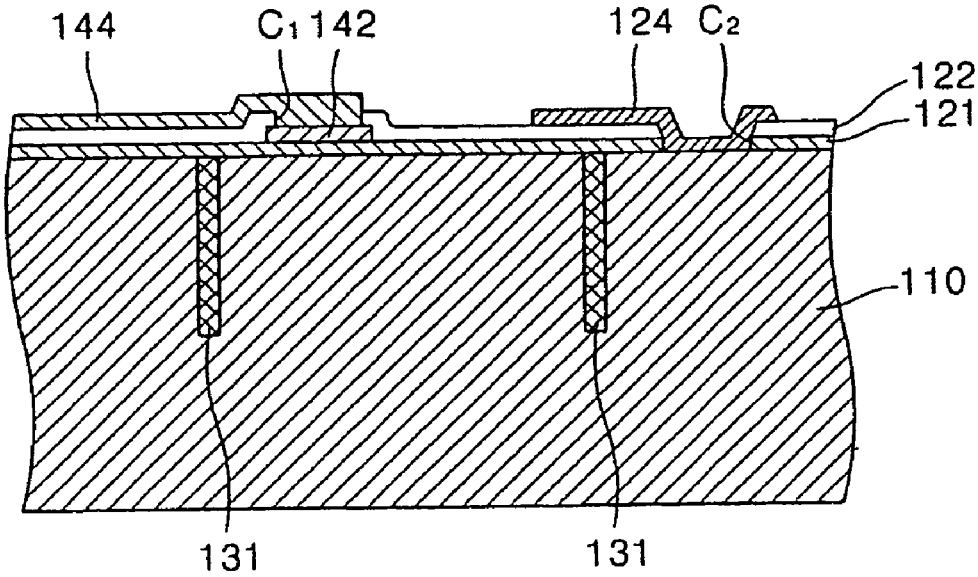

FIG. 14 shows the state in which the conductor 144 and the heat conductive layer 124 have been formed on the second passivation layer 122. Specifically, the conductor 144 and the heat conductive layer 124 can be formed at the same time by depositing a metal having excellent electric and thermal conductivity such as aluminum, aluminum alloy, gold or silver using sputtering techniques to a thickness of the order of about 1 μm and patterning the same. In this case, the conductor 144 and the heat conductive layer 124 are formed insulated from each other, so that the conductor 144 is coupled to the heater 142 through the first contact hole $C_1$ and the heat conductive layer 124 contacts the substrate 110 through the second contact hole $C_2$.

If the heat conductive layer 124 is to be formed more thickly than the conductor 144 or if the heat conductive layer 124 is to be made of a metal other than that of the conductor 144, or to further ensure insulation between the conductor 144 and heat conductive layer 124, the heat conductive layer 124 can be formed after having formed the conductor 144. More specifically, after forming only the first contact hole $C_1$, the conductor 144 is formed. An insulating layer (not shown) would then be formed on the conductor 144 and second passivation layer 122. The insulating layer can be formed from the same material using the same method as the second passivation layer 122. The insulating layer and the second and first passivation layers 122 and 121 are then sequentially etched to form the second contact hole $C_2$. The heat conductive layer 124 would then be formed. Thus, the insulating layer is interposed between the conductor 144 and the heat conductive layer 124.

Figure 15:
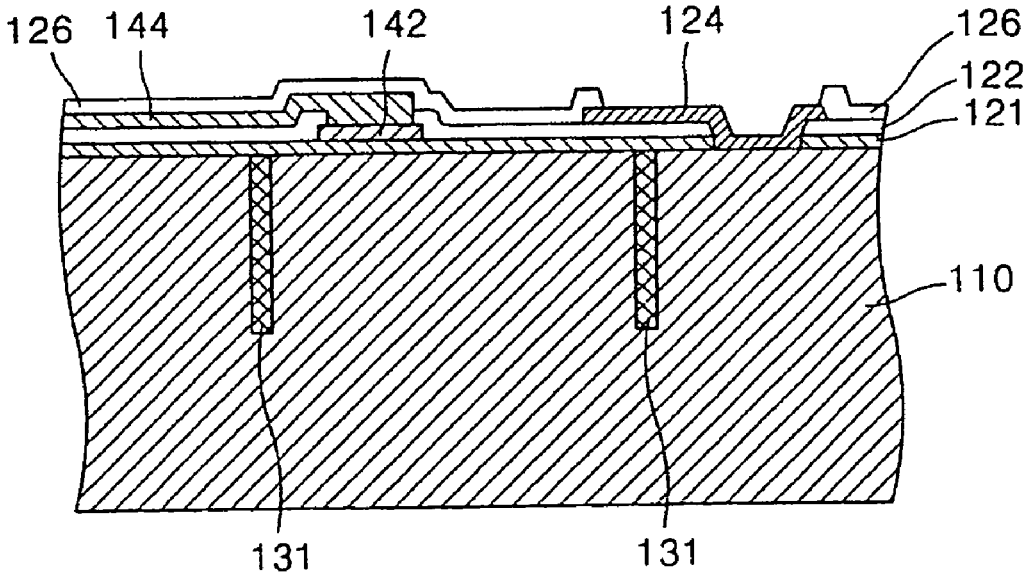

FIG. 15 shows the state in which the third passivation layer 126 has been formed over the entire surface of the resultant structure of FIG. 14. The third passivation layer 126 is formed by depositing tetraethylorthosilicate (TEOS) oxide using plasma enhanced chemical vapor deposition (PECVD) to a thickness of approximately 0.7–3 μm. Then, the third passivation layer 126 is partially etched to expose the heat conductive layer 124.

Figure 16:
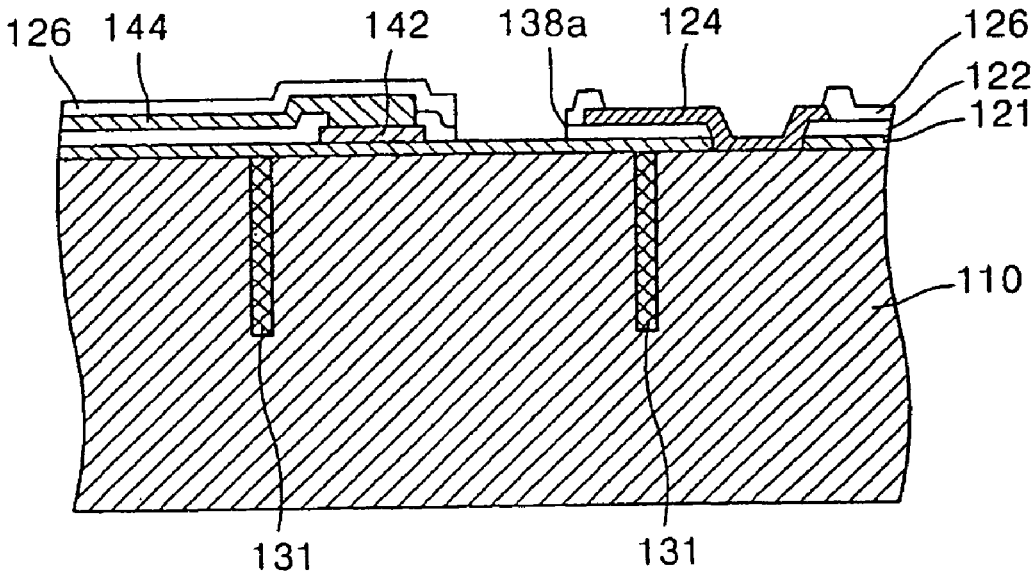

FIG. 16 shows the state in which the lower nozzle 138*a* has been formed. The lower nozzle 138*a* is formed by sequentially etching the third, second, and first passivation layers 126, 122, and 121 using reactive ion etching (RIE).

Figure 17:
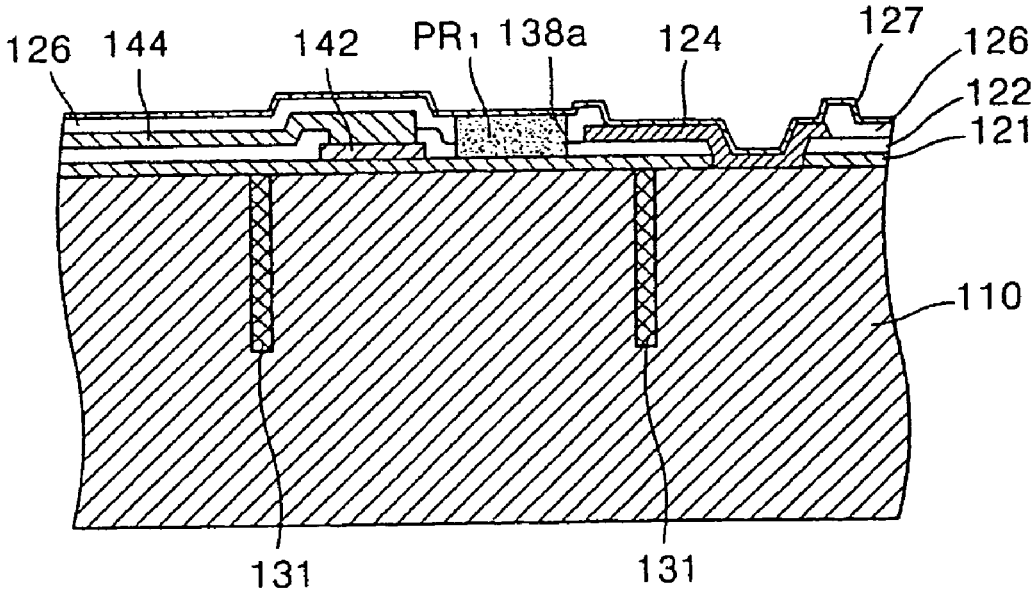

As shown in FIG. 17, a first sacrificial layer $PR_1$ is then formed within the lower nozzle 138*a*. Specifically, a photoresist is applied over the entire surface of the resultant structure of FIG. 16 and patterned to leave only the photoresist filled in the lower nozzle 138*a*. The residual photoresist is used to form the first sacrificial layer $PR_1$ thus maintaining the shape of the lower nozzle 138*a* during the subsequent steps. Next, a seed layer 127 for electroplating is formed over the entire surface of the resulting structure formed after formation of the first sacrificial layer $PR_1$. To carry out the electroplating, the seed layer 127 is formed on the entire surface of the resultant structure. The seed layer 127 may be formed by depositing a metal having good conductivity such as copper (Cu), chrome (Cr), titanium (Ti), gold (Au), or nickel (Ni) to a thickness of approximately 500–3,000 Å using sputtering techniques.

Figure 18:
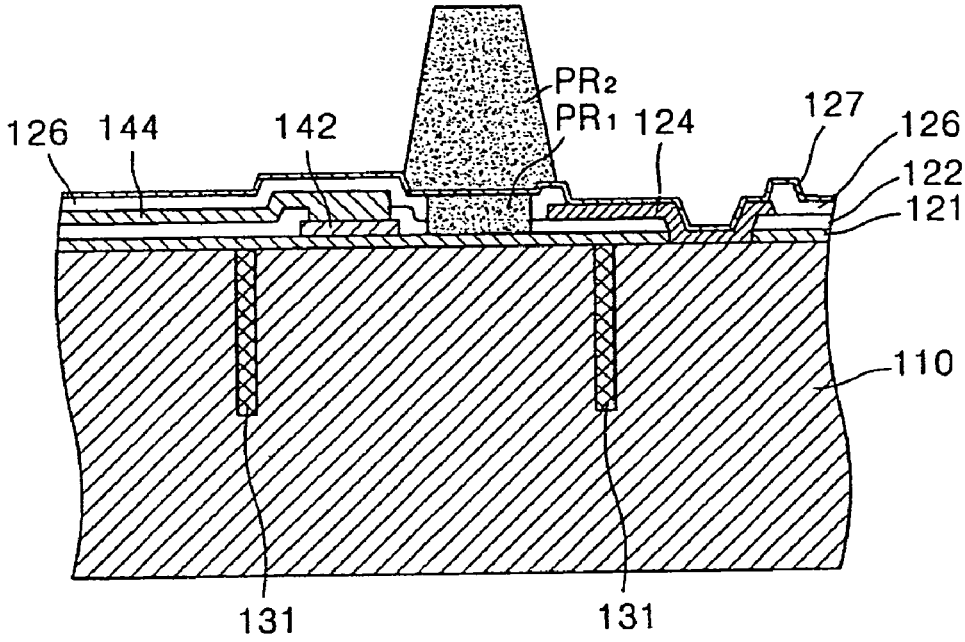
Figure 20:
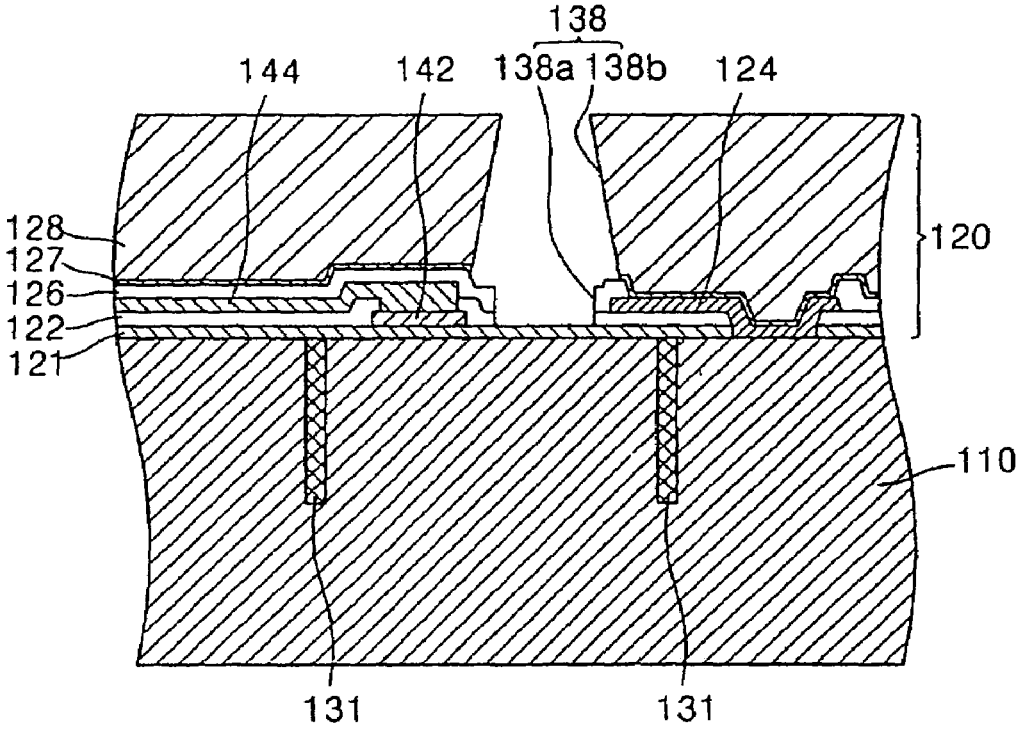

FIG. 18 shows the state in which a second sacrificial layer $PR_2$ for forming the upper nozzle 138*b* has been formed. Specifically, a photoresist is applied over the entire surface of seed layer 127 and patterned to leave the photoresist only at a portion where the upper nozzle 138*a* is to be formed, as shown in FIG. 20. The residual photoresist is formed in a tapered shape having a cross-sectional area that decreases toward an upper portion thereof and acts as the second sacrificial layer $PR_2$ for forming the upper nozzle 138*b* in the subsequent steps.

Meanwhile, if a pillar-shaped upper nozzle 138*b* is to be formed, the second sacrificial layer $PR_2$ is also formed in a pillar-shape. The first and second sacrificial layers $PR_1$ and $PR_2$ can then be made from a photosensitive polymer instead of a photoresist.

Figure 19:
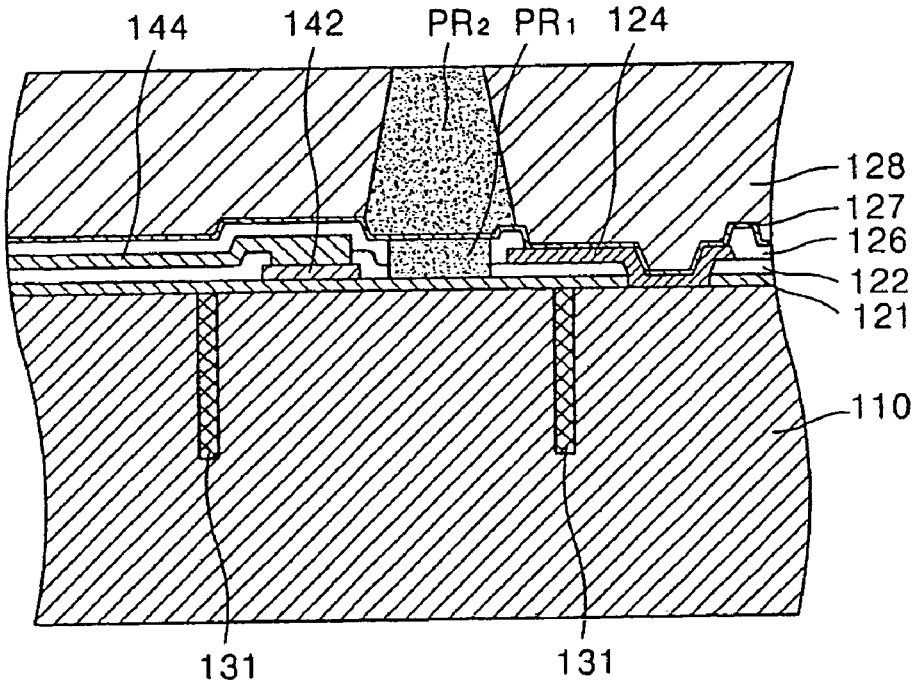

Then, as shown in FIG. 19, the heat dissipating layer 128 is formed from a metal of a predetermined thickness on top of the seed layer 127. The heat dissipating layer 128 can be formed to a thickness of about 10–100 μm by electroplating nickel (Ni), copper (Cu), or gold (Au) over the surface of the seed layer 127. The electroplating process is completed when the heat dissipating layer 128 is formed to a desired height at which an upper opening, i.e., an exit section, of the upper nozzle 138*b* is formed, the height being less than that of the second sacrificial layer $PR_2$. The thickness of the heat dissipating layer 128 may be appropriately determined considering the cross-sectional area and shape of the upper nozzle 138*b* and heat dissipation capability with respect to the substrate 110 and the outside.

Since the surface of the heat dissipating layer 128 that has undergone electroplating has irregularities due to the underlying material layers, it may be planarized by chemical mechanical polishing (CMP).

The second sacrificial layer $PR_2$ for forming the upper nozzle 138*b*, the underlying seed layer 127, and the first sacrificial layer $PR_1$ for maintaining the lower nozzle 138*a* are then sequentially etched to form the complete nozzle 138 by connecting the lower and upper nozzles 138*a* and 138*b* and the nozzle plate 120 comprised of the plurality of material layers.

Alternatively, the nozzle 138 and the heat dissipating layer 128 may be formed through the following steps. Referring to FIG. 23, a seed layer 127' for electroplating is formed over the entire surface of the resulting structure of FIG. 16 before forming the first sacrificial layer $PR_1$ for maintaining the lower nozzle 138*a*. The first sacrificial layer $PR_1$ and the second sacrificial layer $PR_2$ are then sequentially or simultaneously and integrally formed. Next, the heat dissipating layer 128 is formed as shown in FIG. 19, followed by planarization of the surface of the heating dissipating layer 128 by CMP. After the planarization, the second and first sacrificial layers $PR_2$ and $PR_1$, and the underlying seed layer 127' are etched to form the nozzle 138 and nozzle plate 120 as shown in FIG. 20.

FIG. 21 shows the state in which the ink chamber 132 of a predetermined depth has been formed on the front surface of the substrate 110. The ink chamber 132 can be formed by isotropically etching the substrate 110 exposed by the nozzle 138. That is, dry etching is carried out on the substrate 110 using $XeF_2$ or $BrF_3$ gas as an etch gas for a predetermined period of time. The substrate 110 is isotropically etched, that is, the substrate 110 is etched in every direction from the portion exposed by the nozzle 138 at the same etching rate. However, horizontal etching is stopped at the barrier wall 131 serving as an etch stop, etching is performed at the barrier wall 131 in a vertical direction only. Thus, as shown in FIG. 21, the ink chamber 132 surrounded by the barrier wall 131 is formed in a narrow, long, deep shape.

Figure 22:
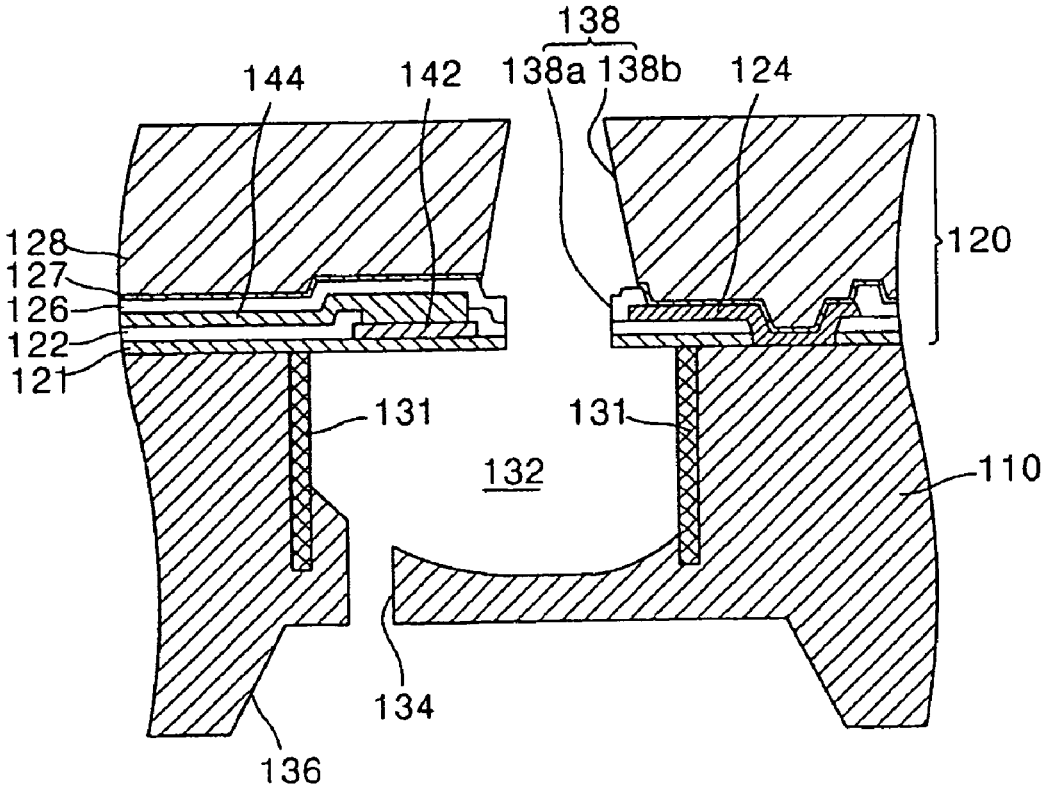
Figure 23:
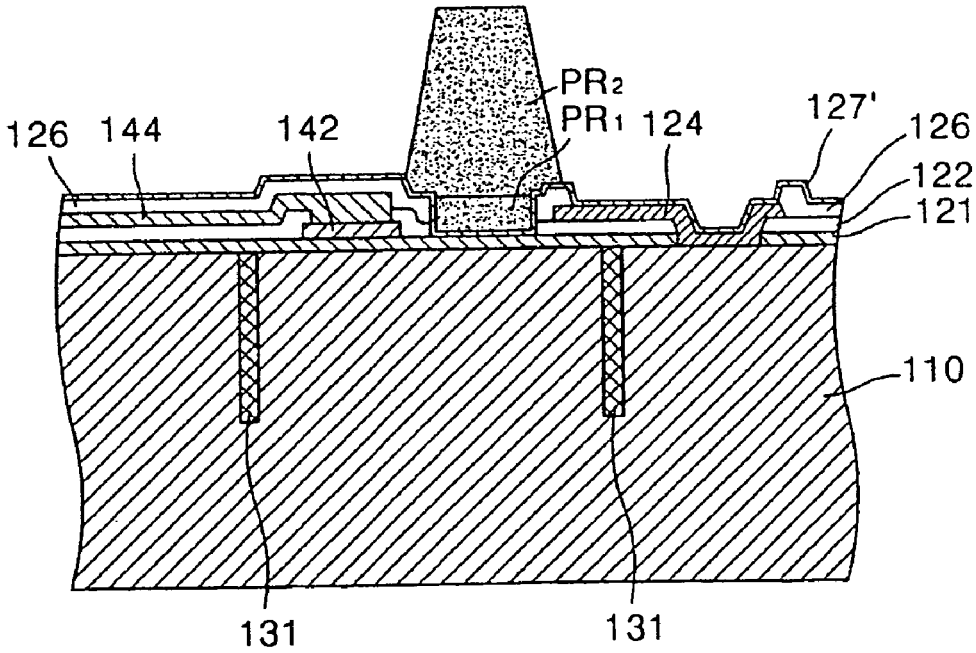
FIG. 23 illustrates an alternate method of forming a seed layer and sacrificial layers.

FIG. 22 shows the state in which the manifold 136 and the ink channel 134 have been formed by etching the substrate 110 from the rear surface thereof. Specifically, an etch mask that limits a region to be etched is formed on the rear surface of the substrate 110, and a wet etching is performed using tetramethyl ammonium hydroxide (TMAH) or potassium hydroxide (KOH) as an etchant to form the manifold 136 having an inclined side surface. Alternatively, the manifold 136 may be formed by anisotropically etching the rear surface of the substrate 110. Subsequently, an etch mask that defines the ink channel 134 is formed on the rear surface of the substrate 110 where the manifold 136 has been formed, and the substrate 110 between the manifold 136 and ink chamber 132 is dry-etched by RIE to form the ink channel 134.

After having undergone the above steps, a monolithic ink-jet printhead according to an embodiment of the present invention having an ink chamber 132 defined by the barrier wall 131 is completed, as shown in FIG. 22.

As described above, according to the present invention, an ink chamber having various shapes adapted to the shape of a barrier wall can be formed. In particular, since a narrow, long ink chamber is formed, a spacing between adjacent nozzles can be reduced.

As described above, the monolithic ink-jet printhead and the manufacturing method thereof according to the present invention have the following advantages.

First, a narrow, long, deep ink chamber can be formed by forming a barrier wall serving as an etch stop. Thus, a spacing between adjacent nozzles can be reduced, thereby realizing an ink-jet printhead capable of printing higher resolution of images with a high level of DPI.

Second, since a nozzle, an ink chamber and an ink channel are not coupled to each other in view of shape and dimension, the degree of freedom is high in the design and manufacture of the ink-jet printhead, thereby easily improving the ink ejection performance and operating frequency.

Third, the present invention improves heat sinking capability due to the presence of a barrier wall made of a metal or a heat dissipation layer made of a thick metal, thereby increasing the ink ejection performance and operating frequency. Also, a sufficient length of the nozzle can be secured so that a meniscus is maintained within the nozzle, thereby allowing stable ink refill operation while increasing the directionality of an ink droplet being ejected.

Fourth, according to the present invention, since a nozzle plate having a nozzle is formed integrally with a substrate having an ink chamber and an ink channel formed thereon, the invention can provide an ink-jet printhead on a single wafer using a monolithic process. This provision eliminates the conventional problems of misalignment between the nozzle and ink chamber, thereby increasing the ink ejection performance and manufacturing yield.

Preferred embodiments of the present invention have been disclosed herein and, although specific terms are employed, they are used and are to be interpreted in a generic and descriptive sense only and not for purpose of limitation. For example, materials used to form each element of a printhead according to this invention may not be limited to those described herein. That is, the substrate may be formed of a material having good processibility, other than silicon, and the same is true of a heater, a conductor, a passivation layer, a heat conductive layer, or a heat dissipating layer. In addition, the stacking and formation method for each material are only examples, and a variety of deposition and etching techniques may be adopted. Furthermore, specific numeric values illustrated in each step may vary within a range in which the manufactured printhead can operate normally. In addition, sequence of process steps in a method of manufacturing a printhead according to this invention may differ. Accordingly, it will be understood by those of ordinary skill in the art that various changes in form and details may be made without departing from the spirit and scope of the present invention as set forth in the following claims.

What is claimed is:

1. A method of manufacturing a monolithic ink-jet printhead comprising:

(a) preparing a substrate;

(b) forming a barrier wall made of a predetermined material different from a material of the substrate;

(c) integrally forming a nozzle plate including a plurality of material layers and having a nozzle penetrating the plurality of material layers, and forming a heater and a conductor connected to the heater between the material layers;

(d) forming an ink chamber defined by the barrier wall by etching the substrate exposed through the nozzle using the barrier wall as an etch stop;

(e) forming a manifold for supplying ink by etching a rear surface of the substrate; and (f) forming an ink channel by etching the substrate so that the ink channel penetrates the substrate between the manifold and the ink chamber.

2. The method as claimed in claim 1, wherein in (a), the substrate is made of a silicon wafer.

3. The method as claimed in claim 1, wherein in (b), the barrier wall surrounds at least a portion of the ink chamber so that the ink chamber is formed in a long, narrow shape.

4. The method as claimed in claim 1, wherein in (b), one side surface of the barrier wall is rounded.

5. The method as claimed in claim 1, wherein in (b), the barrier wall is formed of a metal.

6. The method as claimed in claim 5, wherein (b) comprises:

forming an etch mask defining a portion to be etched on the front surface of the substrate;

forming a trench by etching the substrate exposed through the etch mask to a predetermined depth;

removing the etch mask;

depositing a metal on the front surface of the substrate to fill the trench for forming the barrier wall, and forming a metal material layer made of the metal on the substrate; and removing the metal material layer formed on the substrate.

7. The method as claimed in claim 1, wherein in (b), the barrier wall is formed of an insulating material.

8. The method as claimed in claim 7, wherein the insulating material is silicon oxide or silicon nitride.

9. The method as claimed in claim 7, wherein (b) comprises:

forming an etch mask defining a portion to be etched on the front surface of the substrate;

forming a trench by etching the substrate exposed through the etch mask to a predetermined depth;

removing the etch mask; and depositing the insulating material on the surface of the substrate to fill the trench for forming the barrier wall, and forming an insulating material layer made of the insulating material on the substrate.

10. The method as claimed in claim 1, wherein (c) comprises:

(c1) sequentially stacking a plurality of passivation layers on the substrate and forming the heater and the conductor between the passivation layers; and (c2) forming a heat dissipating layer on the substrate and forming the nozzle so as to penetrate the passivation layers and the heat dissipating layer.

11. The method as claimed in claim 10, wherein (c1) comprises:

forming a first passivation layer on the substrate;

forming the heater on the first passivation layer;

forming a second passivation layer on the first passivation layer and the heater;

forming the conductor on the second passivation layer; and forming a third passivation layer on the second passivation layer and the conductor.

12. The method as claimed in claim 11, wherein the heater is formed in a rectangular shape.

13. The method as claimed in claim 10, wherein in (c1), a heat conductive layer located above the ink chamber is formed between the passivation layers, whereby the heat conductive layer is insulated from the heater and conductor and contacts the substrate and heat dissipating layer.

14. The method as claimed in claim 13, wherein the heat conductive layer is formed by depositing a metal to a predetermined thickness.

15. The method as claimed in claim 13, wherein the heat conductive layer is formed of the same material with the conductor at the same time.

16. The method as claimed in claim 13, wherein an insulating layer is formed on the conductor, and the heat conductive layer is then formed on the insulating layer.

17. The method as claimed in claim 10, wherein in (c2), the heat dissipating layer is formed of nickel, copper, or gold.

18. The method as claimed in claim 10, wherein in (c2), the heat dissipating layer is formed by electric plating to a thickness of about 10–100 μm.

19. The method as claimed in claim 10, wherein (c2) comprises:

etching the passivation layers to form a lower nozzle with a predetermined diameter on a portion where the ink chamber is formed;

forming a first sacrificial layer within the lower nozzle;

forming a second sacrificial layer for forming an upper nozzle on the first sacrificial layer;

forming the heat dissipating layer on the passivation layers by electroplating; and removing the second sacrificial layer and the first sacrificial layer, and forming a complete nozzle consisting of the lower and upper nozzles.

20. The method as claimed in claim 19, wherein the lower nozzle is formed by dry etching the passivation layers using reactive ion etching (RIE).

21. The method as claimed in claim 19, wherein after a seed layer for electroplating the heat dissipating layer is formed on the first sacrificial layer and passivation layers, the second sacrificial layer is formed.

22. The method as claimed in claim 19, wherein after the lower nozzle is formed and a seed layer for electroplating the heat dissipating layer is formed on the substrate exposed by the passivation layers and lower nozzle, the first sacrificial layer and the second sacrificial layer are sequentially formed.

23. The method as claimed in claim 19, wherein after the lower nozzle is formed and a seed layer for electroplating the heat dissipating layer is formed on the substrate exposed by the passivation layers and lower nozzle, the first sacrificial layer and the second sacrificial layer are integrally formed.

24. The method as claimed in claim 19, wherein the first and second sacrificial layers are made from either a photoresist or photosensitive polymer.

25. The method as claimed in claim 19, further comprising:

planarizing the top surface of the heat dissipating layer by chemical mechanical polishing (CMP) after forming the heat dissipating layer.

26. The method as claimed in claim 1, wherein in (d), horizontal etching is stopped and only vertical etching is performed around the barrier wall due to the presence of the barrier wall serving as an etch stop.

27. The method as claimed in claim 1, wherein in (f), the substrate is dry etched by reactive ion etching (RIE) from the rear surface of the substrate on which the manifold has been formed to form the ink channel.

* * * * *